US009045309B2

(12) United States Patent
Hashimoto

(10) Patent No.: US 9,045,309 B2
(45) Date of Patent: Jun. 2, 2015

(54) PAPER SHEET STORING UNIT

(75) Inventor: Shingo Hashimoto, Hyogo (JP)

(73) Assignee: GLORY LTD., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 14/001,213

(22) PCT Filed: Feb. 20, 2012

(86) PCT No.: PCT/JP2012/053938

§ 371 (c)(1),
(2), (4) Date: Aug. 23, 2013

(87) PCT Pub. No.: WO2012/115028

PCT Pub. Date: Aug. 30, 2012

(65) Prior Publication Data

US 2013/0334768 A1 Dec. 19, 2013

(30) Foreign Application Priority Data

Feb. 23, 2011 (JP) ..... 2011-037403
Feb. 23, 2011 (JP) ..... 2011-037409
Feb. 23, 2011 (JP) ..... 2011-037432

(51) Int. Cl.

| | |
|---|---|
| ***B65B 43/26*** | (2006.01) |
| ***B65H 31/22*** | (2006.01) |
| ***B65H 29/46*** | (2006.01) |
| ***B65B 25/14*** | (2006.01) |
| ***B65B 51/00*** | (2006.01) |
| ***B65B 5/06*** | (2006.01) |

(52) U.S. Cl.

CPC ..... *B65H 31/22* (2013.01); *B65H 29/46* (2013.01); *B65H 2405/311* (2013.01); *B65H 2701/1912* (2013.01); *B65B 25/14* (2013.01); *B65B 51/00* (2013.01); *B65B 5/067* (2013.01)

(58) Field of Classification Search

CPC ..... G07F 7/04; G07D 7/00; G07D 7/12; G07D 11/0084; G07D 11/0081; B65H 31/06; B65H 2701/1912; B65H 2701/1916; B65H 29/42; B65H 29/46; B65D 33/1666; B65D 31/10; B65D 33/22; A45C 11/22; B65B 35/50; B65B 5/106; B65B 5/061; B65B 43/465; B65B 43/123; B65B 43/267; B65B 43/26; B65B 43/34; B65B 51/043; B29C 53/14; B29C 53/48; B29C 66/1122; B29C 66/43; B29C 66/80; A61J 3/074

USPC ..... 194/206, 207; 209/534; 271/177, 178, 271/179, 180, 181; 53/447, 540, 570, 53/284.7, 384.1, 549, 469, 459, 468, 477, 53/138.3; 383/68, 94

See application file for complete search history.

(56) References Cited

U.S. PATENT DOCUMENTS

2009/0158694 A1* 6/2009 Matheyka ..... 53/468
2013/0213763 A1* 8/2013 Rao et al. ..... 194/350

FOREIGN PATENT DOCUMENTS

EP 0 852 279 A2 7/1998
EP 1 369 826 A1 12/2003

(Continued)

OTHER PUBLICATIONS

European Search Report (Application No. 12749092.8—PCT/JP2012/053938) (9 pages—dated Jan. 7, 2014).

*Primary Examiner* — Thomas Morrison
(74) *Attorney, Agent, or Firm* — Renner, Kenner, Greive, Bobak, Taylor & Weber

(57) ABSTRACT

First retention member 40 and second retention member 42 are disposed so as to be separately arrayed along a direction orthogonal to a drawing direction, in which the first retention member 40 and the second retention member 42 are drawn from paper sheet storing unit. Upper opening of paper sheet storing bag 50 is sealed when the first retention member 40 moves toward and abuts on the second retention member 42. The first retention member 40 and the second retention member 42 is drawable to outside from the paper sheet storing unit only when the first retention member 40 and the second retention member 42 abut each other.

16 Claims, 16 Drawing Sheets

(56) References Cited

FOREIGN PATENT DOCUMENTS

| | | | |
|---|---|---|---|
| GB | 2 352 006 | A | 1/2001 |
| JP | 10-208108 | | 8/1998 |
| JP | 2003-178350 | | 6/2003 |
| JP | 2008-171334 | | 7/2008 |
| JP | 2010-79543 | | 4/2010 |
| WO | WO 02/19289 | A2 | 3/2002 |
| WO | WO 2008/151773 | A1 | 12/2008 |
| WO | WO 2010/100120 | A1 | 9/2010 |

* cited by examiner

PAPER SHEET STORING UNIT

TECHNICAL FIELD

The present invention relates to a paper sheet storing unit in which a paper sheet taken in the paper sheet storing unit is stored.

BACKGROUND ART

Conventionally, there are well known various types of paper sheet storing units in each of which the paper sheet taken in the paper sheet storing unit is stored. For example, in a banknote processing unit disclosed in Patent Document 1, a pouch is attached between a first frame and a second frame, and the pouch is retained in an opened state by the first frame and the second frame. In the banknote processing unit, when an upper opening of the pouch is sealed after a banknote is stored in the pouch, the first frame is pulled onto a front side of the banknote processing unit to abut the first frame and second frame on each other, thereby sealing the upper opening of the pouch. After the upper opening is sealed, the first frame is further drawn onto the front side, the pouch in which the upper opening is sealed is taken out from the inside of the banknote processing unit, and finally the pouch is collected. An adhesive surface is formed in an inner surface of the pouch, and the upper opening of the pouch is sealed by adhesion of the adhesive surface. After the upper opening is sealed, the first frame is further drawn onto the front side, the pouch in which the upper opening is seated is taken out from the inside of the banknote processing unit, and finally the pouch is collected.

In a banknote processing unit disclosed in Patent Document 2, a banknote storing bag (the pouch) is set in a banknote storage container, and the banknote taken in the container is stored in the banknote storing bag by free fall using transport means.

CITATION LIST

Patent Document

Patent Document 1: EP Patent Application Publication No. EP1369826A1

Patent Document 2: EP Patent Application Publication No. EP0852279A2

SUMMARY OF INVENTION

In the conventional pouch sealing mechanism disclosed in Patent Document 1, as described above, the first frame and the second frame are abutted on each other by drawing the first frame onto the front side of the paper sheet processing unit, the upper opening of the pouch is sealed, and the first frame is further drawn onto the front side after the upper opening is sealed, whereby the pouch in which the upper opening is sealed is taken out from the inside of the paper sheet processing unit. In the sealing mechanism, the first frame is drawn onto the front side of the paper sheet processing unit in two stages (that is, twice before and after the pouch is sealed), and a wide space is required on the front side of the paper sheet processing unit in order to draw the first frame onto the front side. However, sometimes the wide space can hardly be ensured on the front side of the paper sheet processing unit depending on an installation place of the paper sheet storing unit in which the pouch sealing mechanism is provided.

In the conventional pouch sealing mechanism disclosed in Patent Document 1, the frames are attached in the sealing mechanism while the pouch is opened, and the pouch is retained by the frames after the peel-off sheet of the pouch is peeled off to expose the adhesive surface. When the upper opening of the pouch is sealed, the adhesive surfaces adhere to each other in the inner surface of the pouch. However, in the pouch sealing mechanism, because the adhesive surface is exposed when the banknote is stored, there is a risk that the banknote adheres to the adhesive surface formed in the inner surface of the pouch when the banknote is stored in the pouch from above by the free fall. Additionally, because the adhesive surface is exposed, an adhesive force of the adhesive surface is degraded by aging, and there is a risk of insufficiently sealing the upper opening of the pouch.

In the conventional paper sheet storing unit disclosed in Patent Document 2, because only the paper sheet transported into the container is stored by the free fall when the paper sheet is stored in the storing bag, such a stacking failure that the paper sheet becomes an upright state in the storing bag is generated, and unfortunately that a paper sheet storage state of the storing bag becomes a full state is detected even if a small number of paper sheets are stored compared with an actual capacity of the storing bag.

The present invention has been devised to solve the problems described above, and an object thereof is to a paper sheet storing unit that can shorten a drawing distance, in which first and second retention members that retain a paper sheet storing bag are drawn onto the front side of the paper sheet storing unit, to achieve space saving on the front side of the paper sheet storing unit by moving the first retention member in a direction orthogonal to a drawing direction in which the paper sheet storing bag is drawn to the outside from the inside of the paper sheet storing unit when the first and second retention members are abutted on each other to seal the upper opening of the paper sheet storing bag.

Another object of the present invention is to provide a paper sheet storing unit and a paper sheet storing method, which can prevent the paper sheet from adhering to the adhesive surface of the paper sheet storing bag during the storage of the paper sheet in the paper sheet storing bag by reducing the exposure of the adhesive surface of the paper sheet storing bag during, and surely seal the upper opening of the paper sheet storing bag by reducing the degradation of the adhesive force of the adhesive surface the storage of the paper sheet in the paper sheet storing bag.

Still another object of the present invention is to provide a paper sheet storing unit in which a push-in unit that pushes the paper sheet into the paper sheet storing bag placed in the storing unit is provided, and the push-in unit compresses the paper sheet in the paper sheet storing bag every time the paper sheet is stored in the paper sheet storing bag, whereby the stacking failure of the paper sheet can be reduced in the paper sheet storing bag to increase a storage amount of the paper sheet stored in the paper sheet storing bag.

A paper sheet storing unit comprises:

a take-in unit that takes a paper sheet into the paper sheet storing unit; and a storing unit in which a paper sheet storing bag to store the paper sheet is detachably placed, the storing unit storing the paper sheet taken into the paper sheet storing unit by the take-in unit, wherein the storing unit includes a first retention member and a second retention member, the first retention member and the second retention member retaining the paper sheet storing bag while an upper opening of the paper sheet storing bag is opened, the first retention member and the second retention member are separately placed in an identical plane while the paper sheet storing bag is retained between the first retention member and the second retention member, the first retention member and the second retention member can be integrally drawn to an outside from the paper sheet storing unit while retaining the paper sheet storing bag, and the first retention member and the second retention member are disposed so as to be separately arrayed along a direction orthogonal to a drawing direction in which the first retention member and the second retention member are drawn from the paper sheet storing unit, the first retention member is movable toward the second retention member along the direction orthogonal to the drawing direction, and the upper opening of the paper sheet storing bag is sealed when the first retention member moves toward and abuts on the second retention member.

According to the paper sheet storing unit, the first retention member and the second retention member are disposed so as to be separately arrayed along the direction orthogonal to the drawing direction in which the first retention member and the second retention member are drawn from the inside of the paper sheet storing unit, the first retention member is movable toward the second retention member along the direction orthogonal to the drawing direction, and the upper opening of the paper sheet storing bag is sealed when the first retention member moves toward and abuts on the second retention member. The first retention member and the second retention member are drawn from the inside of the paper sheet storing unit only when the first retention member and the second retention member abut on each other. Thus, the drawing distance in which the first and second retention members that retain the paper sheet storing bag are drawn onto the front side of the paper sheet storing unit can be shortened to achieve the space saving on the front side of the paper sheet storing unit by moving the first retention member in the direction orthogonal to the drawing direction in which the paper sheet storing bag is drawn to the outside from the inside of the paper sheet storing unit when the first and second retention members are abutted on each other to seal the upper opening of the paper sheet storing bag.

In the above paper sheet storing unit, a lever may be provided to the first retention member, and the first retention member may move toward the second retention member when the lever is moved.

In this case, a first expansion and contraction mechanism, which can horizontally expand and contract, may be provided between the first retention member and the lever, the first retention member may be attached to a front edge of the first expansion and contraction mechanism, and the first expansion and contraction mechanism may expand when the lever is moved, then the first retention member may move toward the second retention member.

In this case, the first expansion and contraction mechanism may be a pantograph mechanism.

In the above paper sheet storing unit, a lock mechanism that locks the first retention member and the second retention member in the paper sheet storing unit may be provided to the storing unit, the second retention member may be slightly movable along a movement direction of the first retention member, and when the second retention member moves by press of the first retention member, the lock mechanism may be unlocked, then the first retention member and the second retention member may be drawable to the outside from the paper sheet storing unit.

The above paper sheet storing unit, may further comprises:

an escrow plate that is provided above the paper sheet storing bag placed in the storing unit, and that escrows the paper sheet before the paper sheet transported to the storing unit is stored in the paper sheet storing bag; and a push-in plate that pushes the paper sheet escrowed on the escrow plate into the paper sheet storing bag by downwardly pressing the paper sheet, wherein the escrow plate may be pivoted on a shaft, the escrow plate may move between a horizontally extending hold position and a downwardly or obliquely downwardly extending release position, to which the escrow plate turns about the shaft from the hold position, the paper sheet transported to the storing unit may be escrowed on the escrow plate when the escrow plate is located at the hold position, the push-in plate downwardly may press the paper sheet on the escrow plate to move the escrow plate to the release position from the hold position, then the paper sheet on the escrow plate may be pushed into the paper sheet storing bag by the push-in plate.

In this case, the push-in plate may be attached to a front edge of a second expansion and contraction mechanism, which can vertically expand and contract, the push-in plate may downwardly press the paper sheet on the escrow plate by the downward expansion of the second expansion and contraction mechanism, then the escrow plate may move to the release position from the hold position, then the paper sheet on the escrow plate may be pushed into the paper sheet storing bag by the push-in plate.

The escrow plate may close a gap above the first retention member and/or the second retention member when moving to the release position from the hold position.

The above paper sheet storing unit, may further comprises a paper sheet storing bag detection unit that detects whether the paper sheet storing bag is placed in the storing unit.

In this case, a retained member that is retained by each of the first retention member and the second retention member may be provided to the paper sheet storing bag, and the paper sheet storing bag detection unit may detect the retained member.

In this case, the retained member may be made of a material having no optical transparency, and the paper sheet storing bag detection unit may be an optical sensor.

An opening may be provided in the retained member, a protrusion member may be provided to the first retention member and the second retention member, the protrusion member protruding through the opening of the retained member of the paper sheet storing bag when the paper sheet storing bag is placed in the storing unit, and the paper sheet storing bag may be retained by the first retention member and the second retention member when the opening of the retained member is hooked on the protrusion member.

The protrusion member may be provided so as to upwardly extend from each of upper surfaces of the first retention member and the second retention member.

The protrusion member may be retractable into the first retention member and the second retention member, and when the protrusion member retracts into the first retention member and the second retention member, the paper sheet storing bag may be released from the first retention member and the second retention member.

The paper sheet storing unit may further comprises a first-retention-member detection unit that detects a position of the first retention member with respect to the second retention member, wherein an opening degree of the paper sheet storing bag may be detected based on a distance between the first retention member and the second retention member, the distance detected by the first-retention-member detection unit.

The paper sheet storing unit may further comprises a lever detection unit that detects a position of the lever, wherein an opening degree of the paper sheet storing bag may be detected based on a distance between the first retention member and the second retention member, the distance calculated based on the position of the lever detected by the lever detection unit.

A paper sheet storing unit of the present invention includes:

a take-in unit that takes a paper sheet into the paper sheet storing unit; and a storing unit in which a paper sheet storing bag to store the paper sheet is detachably placed, the storing unit storing the paper sheet taken into the paper sheet storing unit by the take-in unit, wherein the storing unit includes a paper sheet storing bag retention member and a peel-off sheet retention member, the paper sheet storing bag retention member retaining the paper sheet storing bag while an upper opening of the paper sheet storing bag is opened, the peel-off sheet retention member retaining a peel-off sheet attached to an adhesive surface of the paper sheet storing bag retained by the paper sheet storing bag retention member, and the peel-off sheet is peeled off from the paper sheet storing bag while retained by the peel-off sheet retention member when the paper sheet storing bag retention member that retains the paper sheet storing bag moves to seal the upper opening of the paper sheet storing bag.

According to the paper sheet storing unit, the peel-off sheet is attached to the adhesive surface when the paper sheet is stored in the paper sheet storing bag, so that the exposure of the adhesive surface of the paper sheet storing bag can be reduced during the storage of the paper sheet. Therefore, the paper sheet can be prevented from adhering to the adhesive surface during the storage of the paper sheet in the paper sheet storing bag, and the upper opening of the paper sheet storing bag can surely be sealed by reducing the degradation of the adhesive force of the adhesive surface. Additionally, the peel-off sheet can easily be peeled off from the adhesive surface only by moving the paper sheet storing bag retention member.

In the paper sheet storing unit, the paper sheet storing bag retention member may include a first retention member and a second retention member, the first retention member and the second retention member separately placed in an identical plane, the paper sheet storing bag may be retained between the first retention member and the second retention member, the first retention member may be movable toward the second retention member, the upper opening of the paper sheet storing bag may be sealed when the first retention member moves toward and abuts on the second retention member, the peel-off sheet retention member may be provided near the first retention member, the first retention member and the peel-off sheet retention member may separate from each other when the first retention member moves to seal the upper opening of the paper sheet storing bag, and the peel-off sheet may be peeled off from the paper sheet storing bag while retained by the peel-off sheet retention member.

In this case, the first retention member and the second retention member may be integrally drawable to an outside from the paper sheet storing unit while retaining the paper sheet storing bag, the first retention member and the second retention member may be disposed so as to be separately arrayed along a direction orthogonal to a drawing direction in which the first retention member and the second retention member are drawn from the paper sheet storing unit, and the first retention member may be movable toward the second retention member along the direction orthogonal to the drawing direction.

Alternatively, the first retention member and the second retention member may be integrally drawable to an outside from the paper sheet storing unit while retaining the paper sheet storing bag, the first retention member and the second retention member may be disposed so as to be separately arrayed along the drawing direction in which the first retention member and the second retention member are drawn from the paper sheet storing unit, and the first retention member may be movable toward the second retention member along the drawing direction.

The above paper sheet storing unit may further comprise a peel-off sheet detection unit that detects the peel-off sheet retained by the peel-off sheet retention member.

In the above paper sheet storing unit, an end portion on the adhesive surface side of the peel-off sheet that should be retained by the peel-off sheet retention member may be folded at least once, and the folded front edge portion may be attached to the adhesive surface of the paper sheet storing bag.

A paper sheet storing method of the present invention is the paper sheet storing method for storing the paper sheet in the paper sheet storing bag, the paper sheet storing method comprises:

a step in which the paper sheet storing bag is retained by paper sheet storing bag retention member, a step in which the peel-off sheet attached to the adhesive surface of the paper sheet storing bag is retained by the peel-off sheet retention member, and a step in which the paper sheet storing bag retention member that retains the paper sheet storing bag is moved to seal the upper opening of the paper sheet storing bag and, at the same time, the peel-off sheet is peeled off from the paper sheet storing bag while retained by the peel-off sheet retention member.

In the above paper sheet storing method, the paper sheet storing bag retention member may be a first retention member and a second retention member, the first retention member and the second retention member may be separately placed in an identical plane, the paper sheet storing bag may be retained between the first retention member and the second retention member, the first retention member may be movable toward the second retention member, the upper opening of the paper sheet storing bag may be sealed when the first retention member moves toward and abuts on the second retention member, the peel-off sheet retention member may be provided near the first retention member in the step in which the paper sheet storing bag retention member that retains the paper sheet storing bag may be moved to seal the upper opening of the paper sheet storing bag, the first retention member of the paper sheet storing bag retention member may move toward and abut on the second retention member to seal the upper opening of the paper sheet storing bag and, at the same time, the first retention member and the peel-off sheet retention member may separate from each other, whereby the peel-off sheet may peeled off from the paper sheet storing bag while retained by the peel-off sheet retention member.

A paper sheet storing unit of the present invention comprises:

a take-in unit that takes a paper sheet into the paper sheet storing unit;

a storing unit in which a paper sheet storing bag is detachably placed, the paper sheet stored in the paper sheet storing bag, the paper sheet taken into the paper sheet storing unit by the take-in unit stored in the storing unit; and a push-in unit that pushes the paper sheet into the paper sheet storing bag placed in the storing unit.

According to the paper sheet storing unit, because the push-in unit is provided in order to push the paper sheet in the paper sheet storing bag placed in the storing unit, the paper sheets in the paper sheet storing bag can be compressed by the push-in unit every time the paper sheet is stored in the paper sheet storing bag, and the generation of the stacking failure of the paper sheet can be reduced in the paper sheet storing bag. Therefore, a storage amount of the paper sheet stored in the paper sheet storing bag can be increased.

In the above paper sheet storing unit, the push-in unit may push the paper sheet in the paper sheet storing bag by downwardly pressing the paper sheet.

The above paper sheet storing unit may further comprise:

a storage state detection unit that detects that the paper sheet stored in the paper sheet storing bag reaches a storage limit position; and a control unit that controls the push-in unit, wherein the control unit may control the push-in unit such that the push-in unit pushes the paper sheet into the paper sheet storing bag when the storage state detection unit detects that the paper sheet stored in the paper sheet storing bag reaches the storage limit position.

In this case, the control unit may determine that a paper sheet storage state of the paper sheet storing bag reaches a storage limit when the storage state detection unit detects that the paper sheet stored in the paper sheet storing bag remains at the storage limit position after the push-in unit pushes the paper sheet into the paper sheet storing bag.

When determining that the paper sheet storage state of the paper sheet storing bag reaches the storage limit, the control unit may control the push-in unit again to repeat the action in which the push-in unit pushes the paper sheet into the paper sheet storing bag one or a plenty of times.

In the above paper sheet storing unit, the push-in unit may include an expansion and contraction mechanism that can vertically expand and contract, and a push-in member that is attached to a front end of the expansion and contraction mechanism, and the push-in member may push paper sheet into the paper sheet storing bag by downwardly expanding the expansion and contraction mechanism.

In this case, the push-in member may enter the paper sheet storing bag placed in the storing unit when the expansion and contraction mechanism completely expands.

The paper sheet storing unit may further comprise a control unit that controls the expansion and contraction mechanism of the push-in unit, a detected member that moves in conjunction with expansion and contraction action of the expansion and contraction mechanism may be attached to the expansion and contraction mechanism, first and second expansion and contraction mechanism detection units that detect the detected member may be provided to the storing unit, the first expansion and contraction mechanism detection unit may detect the detected member in a process in which the expansion and contraction mechanism expands downward from the contraction state, and the second expansion and contraction mechanism detection unit may detect the detected member when the expansion and contraction mechanism completely expands, and the control unit may determine that the paper sheet storage state of the paper sheet storing bag reaches the storage limit when the first expansion and contraction mechanism detection unit detects the detected member while the second expansion and contraction mechanism detection unit does not detect the detected member.

In this case, when determining that the paper sheet storage state of the paper sheet storing bag reaches the storage limit, the control unit may control the expansion and contraction mechanism again to repeat the action, in which the push-in unit pushes the paper sheet into the paper sheet storing bag by expanding the expansion and contraction mechanism again after the contraction, one or a plenty of times.

The expansion and contraction mechanism may be a pantograph mechanism.

In the above paper sheet storing unit, a protrusion that protrudes obliquely downward in the paper sheet storing bag may be provided in the inner surface of the paper sheet storing bag placed in the storing unit.

DESCRIPTION OF EMBODIMENTS

First Embodiment

Hereinafter, in a first embodiment of the present invention, the case that a banknote cash unit that processes a banknote is used will be described as a paper sheet storing unit according to the present invention. A cash unit in which the banknote cash unit and a coin cash unit are combined will also be described in the first embodiment.

Figure 1:
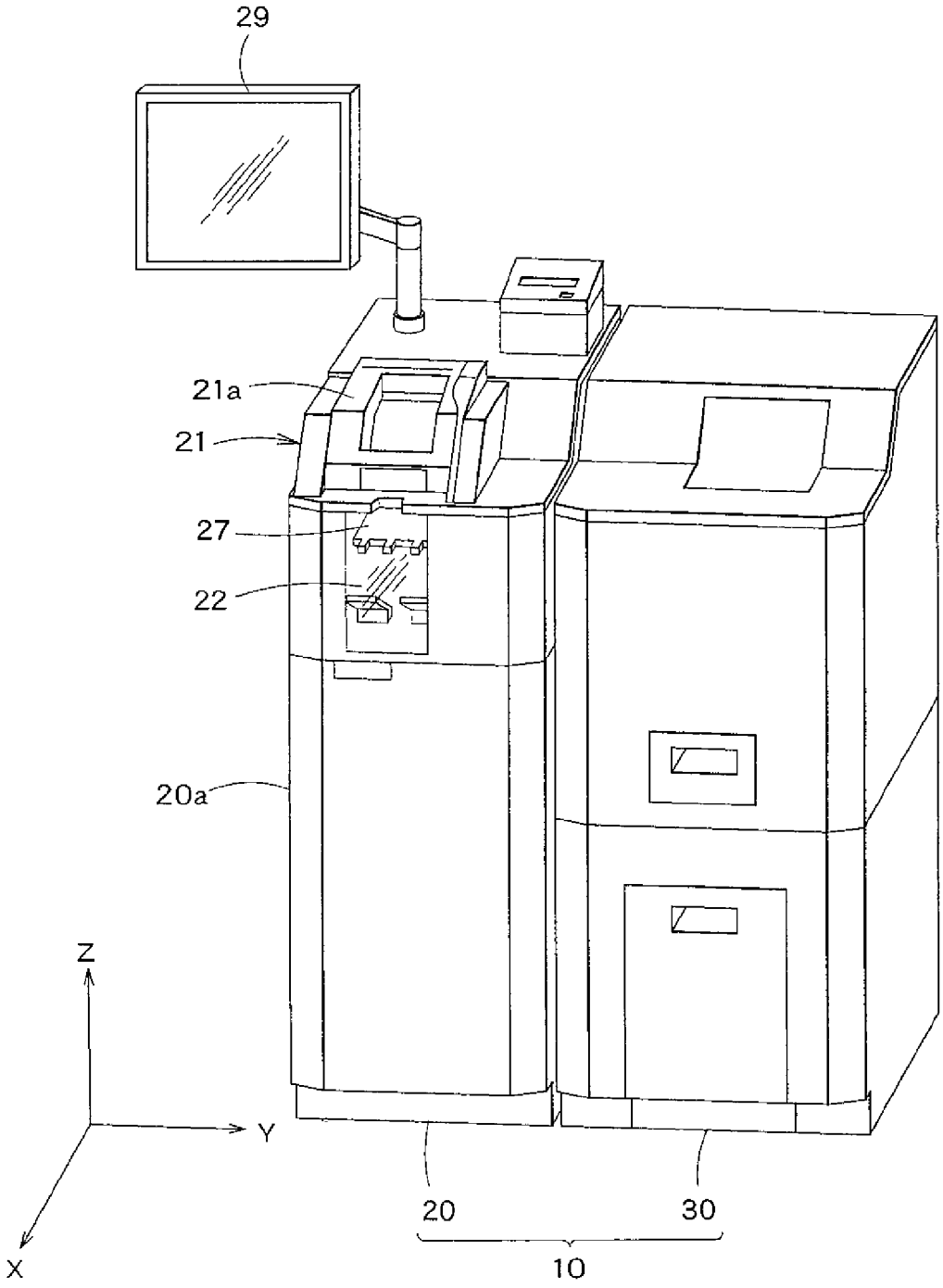
FIG. 1 is a perspective view illustrating an exterior of a cash unit according to a first embodiment of the present invention.
Figure 2:
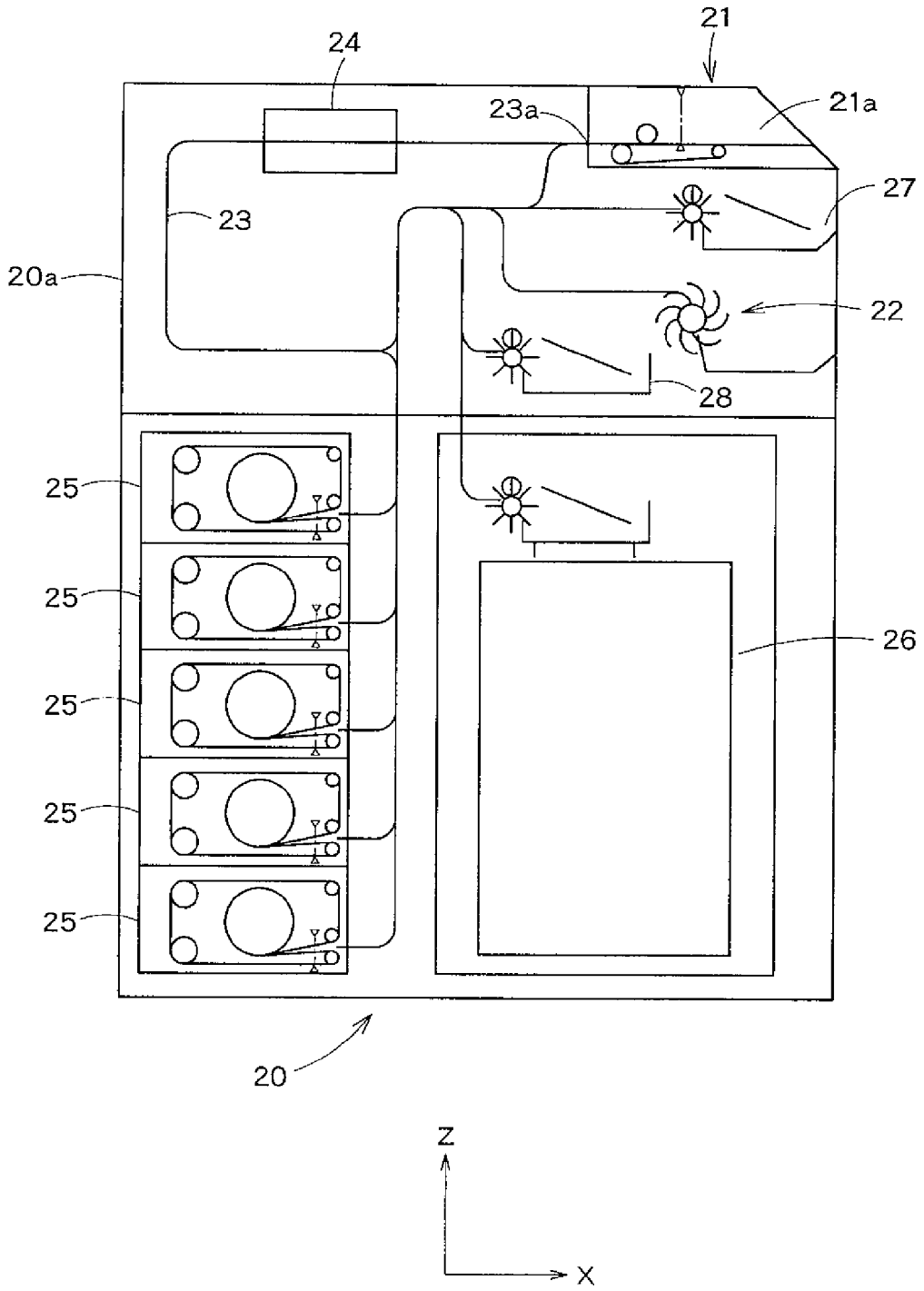
FIG. 2 is a configuration diagram illustrating an internal configuration a banknote cash unit of the cash unit in FIG. 1.

FIGS. 1 to 13 are views illustrating the banknote cash unit of the first embodiment and the cash unit including the banknote cash unit. FIG. 1 is a perspective view illustrating the cash unit of the first embodiment of the present invention, and FIG. 2 is a configuration diagram illustrating an internal configuration of the banknote cash unit in the cash unit in FIG. 1. FIGS. 3 to 13 are views illustrating a configuration of a storing unit provided in the banknote cash unit in FIG. 2.

The configuration of the cash unit 10 will be described with reference to FIG. 1. Generally, a store such as a supermarket is divided into a front area where a store clerk deposits and dispenses cash actually exchanged with a customer and a backyard area where the cash and goods in the front area are managed, one or a plenty of cash settlement units are placed in the front area, and the cash unit 10 in FIG. 1 is placed in the backyard area. The cash settlement unit is operated by the store clerk, and settlement processing between the store clerk and the customer is performed with the cash settlement unit. For example, a payment for a purchase is deposited in the cash settlement unit, and change paid to the customer is dispensed from the cash settlement unit. Change fund with which the cash settlement unit is loaded is dispensed from the cash unit 10, and proceeds of sales collected from the cash settlement unit are deposited in the cash unit 10. The cash is given and received between the cash settlement unit and the cash unit 10 with the cash transport cassette that is detachably attached to each of the cash settlement unit and the cash unit 10. The cash stored in the cash transport cassette cannot be taken out when the cash transport cassette is detached from the cash settlement unit or the cash unit 10.

As illustrated in FIG. 1, the cash unit 10 placed in the backyard area includes a banknote cash unit 20 and a coin cash unit 30. The banknote with which the cash settlement unit placed in the front area is loaded is dispensed from the banknote cash unit 20, or the banknote collected from the cash settlement unit is deposited in the banknote cash unit 20. The coin with which the cash settlement unit placed in the front area is loaded is dispensed from the coin cash unit 30, or the coin collected from the cash settlement unit is deposited in the coin cash unit 30.

The schematic configuration of the banknote cash unit 20 will be described below with reference to FIGS. 1 and 2. As illustrated in FIG. 1, the banknote cash unit 20 includes a chassis 20*a*, a deposit unit 21, a dispensing unit 22, and an operation/display unit 29, and a banknote receiving unit 21*a* is detachably attached to the deposit unit 21. The banknote receiving unit 21*a* receives the banknote from the outside of the banknote cash unit 20, and feeds the banknote to the chassis 20*a* one by one. The banknote receiving unit 21*a* is used when the store clerk manually deposits the banknote in the banknote cash unit 20. Instead of the banknote receiving unit 21*a*, the cash transport cassette may be attached to the deposit unit 21. When the cash transport cassette is attached to the deposit unit 21, the banknote in the cash transport cassette is fed into the chassis 20*a* one by one using a feeding mechanism provided in the cash transport cassette.

As illustrated in FIG. 2, a transport unit 23 that transports the banknote one by one is provided in the chassis 20*a* of the banknote cash unit 20, and the deposit unit 21 is provided in an end portion 23*a* of a transport unit 23. When the banknote receiving unit 21*a* is attached to the deposit unit 21, the banknote fed from the banknote receiving unit 21*a* is transported by the transport unit 23 through the end portion 23*a* of the transport unit 23.

As illustrated in FIG. 2, a recognition unit 24 is provided in the transport unit 23, and the recognition unit 24 recognizes denomination, fitness, and authentication of the banknote transported by the transport unit 23.

A plenty of storing/feeding units 25 are provided in the chassis 20*a*, and the transport unit 23 is connected to each of the storing/feeding units 25. The banknote is stored in each storing/feeding unit 25 by denomination. More particularly, the transport unit 23 transports the banknote, which is fed from the deposit unit 21 to the transport unit 23, to each storing/feeding unit 25 by denomination based on a recognition result of the recognition unit 24. Each storing/feeding unit 25 can feed the banknote stored in the storing/feeding unit 25 to the transport unit 23 one by one. Each storing/feeding unit 25 may be a tape-reel type storing/feeding unit in which a pair of tapes is wound together with the banknote while the banknote is sandwiched between the tapes one by one as illustrated in FIG. 2, or a stacker type storing/feeding unit (not illustrated) in which the banknotes are stored while stacked on each other.

A storing unit (collect uniting) 26 is provided in the chassis 20*a*, and the storing unit 26 is used when the banknote stored in the storing/feeding unit 25 is collected. More specifically, a banknote storing bag 50 (described later) in which the banknote is stored is detachably placed in the storing unit 26, and the banknote transported to the storing unit 26 from the storing/feeding unit 25 through the transport unit 23 is stored in the banknote storing bag 50. The banknote of the denomination that is not allocated to the storing/feeding units 25 or the overflow banknote of the corresponding denomination, which cannot be stored in the storing/feeding unit 25 because the banknote storing/feeding unit 25 is filled with the banknotes, is also stored in the banknote storing bag 50. The banknotes are collected in each banknote storing bag 50 from the banknote cash unit 20 by taking out the banknote storing bag 50 from the storing unit 26. The detailed configuration of the storing unit 26 is described later.

As illustrated in FIG. 2, an external reject unit 27 and an internal reject unit 28 are provided in the banknote cash unit 20. In the banknotes taken in the chassis 20*a* by the deposit unit 21, the banknote that is recognized as an abnormal banknote by the recognition unit 24 is transported as a rejected banknote to the external reject unit 27 from the transport unit 23, and the external reject unit 27 throws the rejected banknote to the outside of the banknote cash unit 20. On the other hand, the rejected banknote that cannot be thrown to the outside of the banknote cash unit 20 is transported to the internal reject unit 28 from the transport unit 23, and the rejected banknote is stored in the internal reject unit 28. An operator such as the store clerk who does not have management authority cannot take out the banknote in the internal reject unit 28.

The operation/display unit 29 is configured to display various pieces of information such as a storage state of the banknote or the coin in the cash unit 10, and such that the store clerk can input data. For example, the operation/display unit 29 is constructed by a touch panel type display. The operation/display unit 29 is provided in one of the banknote cash unit 20 and the coin cash unit 30, and commonly used in order to display the pieces of information of both the banknote cash unit 20 and the coin cash unit 30.

The detailed configuration of the storing unit 26 in the banknote cash unit 20 will be described below with reference to FIGS. 3 to 13.

In the banknote cash unit 20 of this embodiment, as described above, the banknote storing bag 50 in which the banknote is stored is detachably attached to the storing unit 26, and the banknote transported to the storing unit 26 from the transport unit 23 is stored in the banknote storing bag 50 placed in the storing unit 26.

Figure 3:
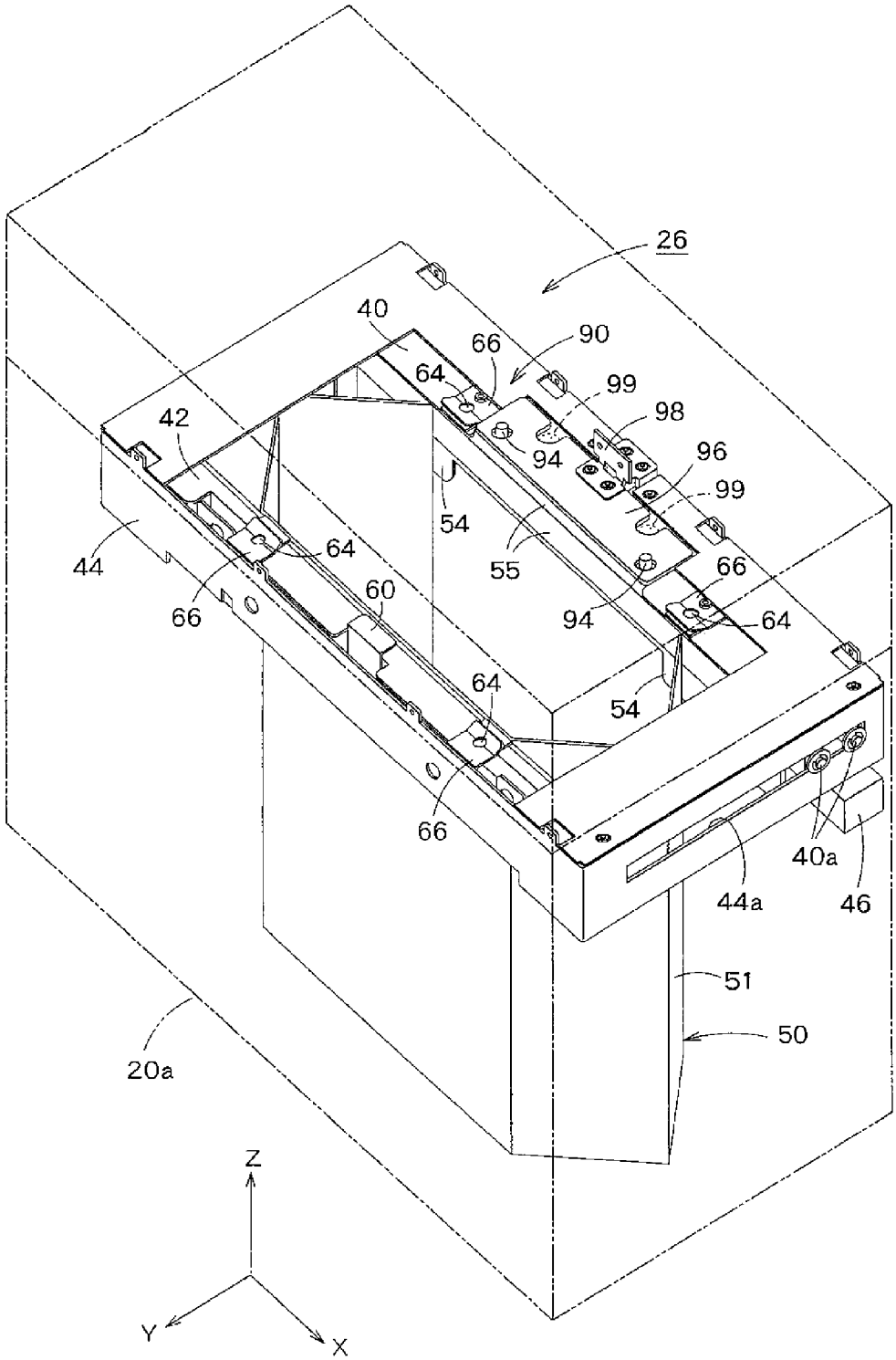
FIG. 3 is a perspective view illustrating configurations of first and second retention members provided in a storing unit of the banknote cash unit in FIG. 2.

As illustrated in FIG. 3, the storing unit 26 includes a first retention member 40 and a second retention member 42, which retain the banknote storing bag 50 while an upper opening of the banknote storing bag 50 is opened, the first retention member 40 and the second retention member 42 are separately placed in an identical horizontal plane, and the banknote storing bag 50 is retained between the first retention member 40 and the second retention member 42. A frame body 44 is provided in the storing unit 26, and the first retention member 40 and the second retention member 42 are retained by the frame body 44. In FIG. 3, an X-direction is a depth direction (a crosswise direction in FIG. 2) of the chassis 20*a* of the banknote cash unit 20, a Y-direction is a width direction (a direction orthogonal to a paper plane in FIG. 2) of the chassis 20*a* of the banknote cash unit 20, and a Z-direction is a height direction (an up-and-down direction in FIG. 2) of the chassis 20*a* of the banknote cash unit 20.

In the storing unit 26 of this embodiment, the first retention member 40 and the second retention member 42 are separately arrayed along the Y-direction that is of the width direction of the chassis 20*a*. The first retention member 40 is movable toward the second retention member 42 along the Y-direction. The first retention member 40 moves toward the second retention member 42, and abuts on the second retention member 42. At this point, the upper opening of the banknote storing bag 50 is sealed. In the storing unit 26 of this embodiment, the first retention member 40 and the second retention member 42 are drawable onto the front side (that is, the X-direction in FIG. 3) from the chassis 20*a* only in the state in which the first retention member 40 and the second retention member 42 abut on each other.

Figure 4:
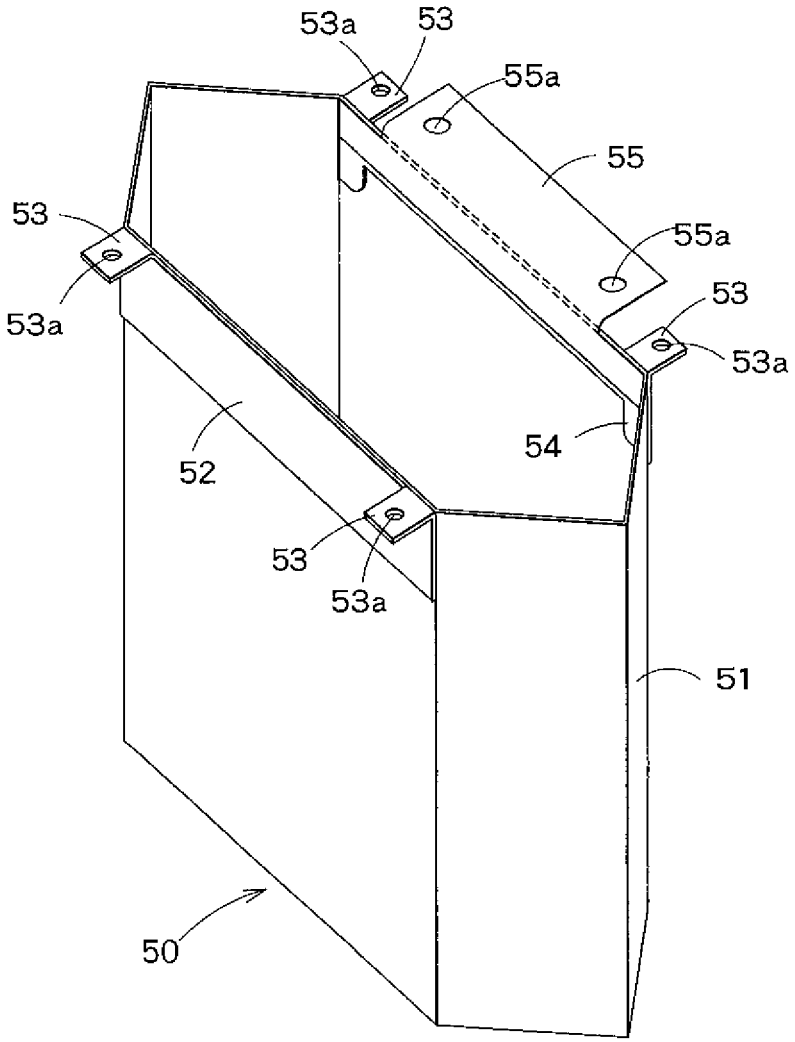
FIG. 4 is a perspective view illustrating a configuration of a banknote storing bag that should be installed in the storing unit of the banknote cash unit in FIG. 2.

The configuration of the banknote storing bag 50 will be described with reference to FIGS. 4 and 5 before the detailed configuration of the storing unit 26 is described. FIG. 4 is a perspective view illustrating the configuration of the banknote storing bag 50 that should be placed in the storing unit 26, and FIG. 5 is a sectional view of the banknote storing bag 50 in FIG. 4.

Figure 5:
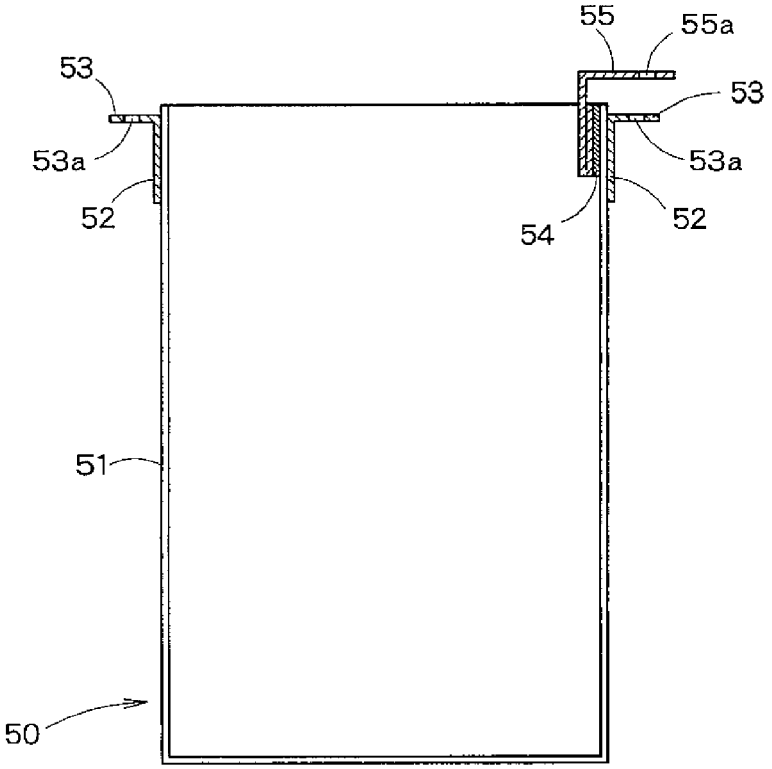
FIG. 5 is a sectional view of the banknote storing bag in FIG. 4.

As illustrated in FIGS. 4 and 5, the banknote storing bag 50 includes a bag body 51 in which an upper portion is opened. For example, the bag body 51 is made of a transparent or translucent vinyl resin (such as polyethylene). The bag body 51 may be painted in black or the like such that the banknote stored in the banknote storing bag 50 is not seen from the outside. Antistatic finish is performed to an inner surface of the bag body 51. A wedge is provided in a bottom portion of the bag body 51, thereby increasing a banknote storage amount of the banknote storing bag 50.

As illustrated in FIGS. 4 and 5, a pair of retained members 52 is attached to the upper portion of an outer surface of the bag body 51, and the retained members 52 are retained by the first retention member 40 and the second retention member 42, respectively. For example, each retained member 52 is made of a black film material having no optical transparency. The elastic film material prevents generation of a wrinkle in the bag body 51 or helps attachment of a pouch. A pair of hook portions 53 is provided at an upper end of each retained member 52 so as to be bent at a right angle from the retained member 52, and an opening 53*a* is formed in each hook portion 53. The hook portions 53 are retained by the first retention member 40 and the second retention member 42.

Specifically, a banknote storing bag fixing pin 64 protrudes through the opening 53*a* formed in each hook portion 53, whereby the hook portions 53 are retained by the first retention member 40 and the second retention member 42. A perforation is formed between each hook portion 53 and the retained member 52, whereby the hook portion 53 can easily be bent from the retained member 52.

As illustrated in FIGS. 4 and 5, an adhesive surface 54 is formed in the upper portion of the inner surface of the bag body 51, and a peel-off sheet 55 is attached to the adhesive surface 54. At this point, as illustrated in FIG. 5, an end portion on the side of the adhesive surface 54 in the peel-off sheet 55 is folded twice in the identical direction, and a front edge portion that is folded twice is attached to the adhesive surface 54. A pair of openings 55*a* is formed in a place distant from the bag body 51 in the peel-off sheet 55 (see FIG. 4), and a peel-off sheet fixing pin 94 can protrude through the opening 55*a*. The end portion on the side of the adhesive surface 54 in the peel-off sheet 55 is not limited to the above configuration. Alternatively, for example, the end portion on the side of the adhesive surface 54 in the peel-off sheet 55 is folded only once to form a V-shape, and the folded front edge portion may be attached to the adhesive surface 54. In this case, the portion on the opposite side to the folded front edge portion in the peel-off sheet 55 is folded when the peel-off sheet 55 is retained by a peel-off sheet retention member 90.

Figure 6:
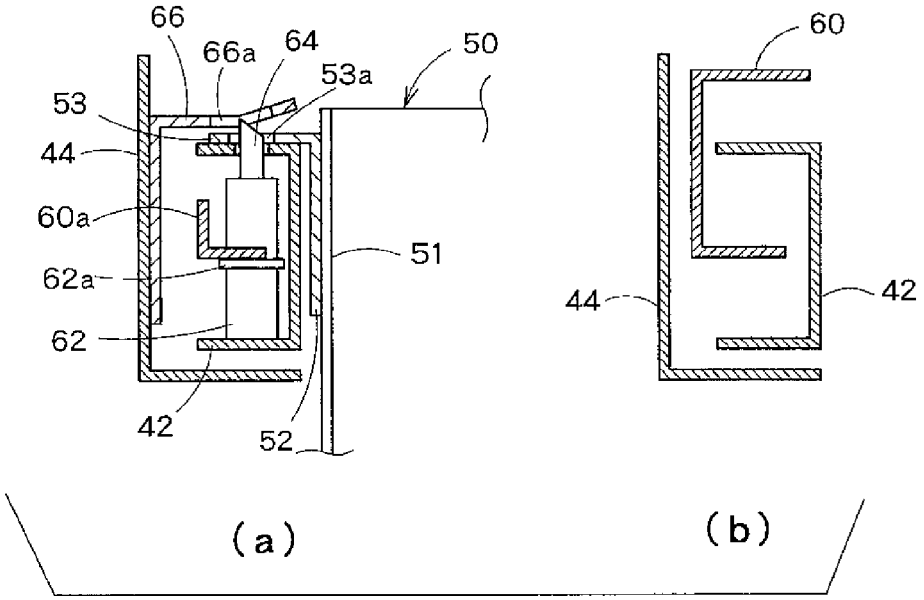
FIG. 6(*a*) is a sectional view illustrating a configuration of a banknote storing bag fixing pin that fixes the banknote storing bag, and FIG. 6(*b*) is a sectional view illustrating a configuration of a bag unfixing lever that releases the banknote storing bag from the banknote storing bag fixing pin.

A configuration in which the banknote storing bag 50 is retained by the first retention member 40 and the second retention member 42 will be described in detail with reference to FIG. 6.

When the banknote storing bag 50 is retained by the first retention member 40 and the second retention member 42, the banknote storing bag fixing pins 64 are protruded through the openings 53*a* of the pair of hook portions 53 provided in the retained member 52. FIG. 6(*a*) is a sectional view illustrating the configuration of the banknote storing bag fixing pin 64. As illustrated in FIG. 6(*a*), a pin accommodation member 62 is provided in each of the first retention member 40 and the second retention member 42 (FIG. 6(*a*) illustrates the pin accommodation member 62 provided in the second retention member 42), and the banknote storing bag fixing pin 64 is accommodated in each pin accommodation member 62. A compression spring (not illustrated) is accommodated in the pin accommodation member 62, and the banknote storing bag fixing pin 64 expands and contracts in the up-and-down direction by the compression spring. A hook section 62*a* is provided in the pin accommodation member 62, and the banknote storing bag fixing pin 64 retract downward when the hook section 62*a* is pushed down. In FIG. 6(*a*), the pin accommodation member 62 is provided in the second retention member 42. The pin accommodation member 62 is also provided in the first retention member 40.

A cover member 66 is attached to the first retention member 40, and an opening 66*a* is formed in the cover member 66. The banknote storing bag fixing pin 64 is protruded through the opening 66*a* of the cover member 66. The banknote storing bag fixing pin 64 protrudes through the opening 53*a* while the hook portion 53 in the retained member 52 of the banknote storing bag 50 is sandwiched between the upper surface of the first retention member 40 or the second retention member 42 and the cover member 66, whereby the hook portion 53 is fixed to the banknote storing bag fixing pin 64. As illustrated in FIG. 6(*a*), the upper surface of the banknote storing bag fixing pin 64 is inclined in an oblique direction. Therefore, when the operator hooks the hook portion 53 in the retained member 52 of the banknote storing bag 50 on the first retention member 40 or the second retention member 42, the hook portion 53 is inserted in a gap between the upper surface of the first retention member 40 or the second retention member 42 and the cover member 66, and the inclined upper surface of the banknote storing bag fixing pin 64 is pressed by the hook portion 53 to retract automatically downward, which allows the banknote storing bag fixing pin 64 to protrude through the opening 53*a* of the hook portion 53.

A bag unfixing lever 60 is provided in each of the first retention member 40 and the second retention member 42 (in FIG. 3, although the bag unfixing lever 60 provided in the second retention member 42 is illustrated, the bag unfixing lever 60 provided in the first retention member 40 is not illustrated because the bag unfixing lever 60 is hidden behind the peel-off sheet retention member 90). FIG. 6(*b*) is a sectional view illustrating the configuration of the bag unfixing lever 60. The operator can press the bag unfixing lever 60 downward. The bag unfixing lever 60 is connected to a pressing section 60*a* that downwardly presses the hook section 62*a* of the pin accommodation member 62 in FIG. 6(*a*). When the banknote storing bag fixing pin 64 protrudes through the opening 53*a* while the hook portion 53 in the retained member 52 of the banknote storing bag 50 is sandwiched between the upper surface of the first retention member 40 or the second retention member 42 and the cover member 66, the downward press of the bag unfixing lever 60 causes the pressing section 60*a* to downwardly press the hook section 62*a* of the pin accommodation member 62, and the banknote storing bag fixing pin 64 retracts downward. Therefore, the banknote storing bag fixing pin 64 falls out of the opening 53*a* of the hook portion 53, and the operator can take out the portion 53 of the banknote storing bag 50 from the first retention member 40 or the second retention member 42.

Figure 7:
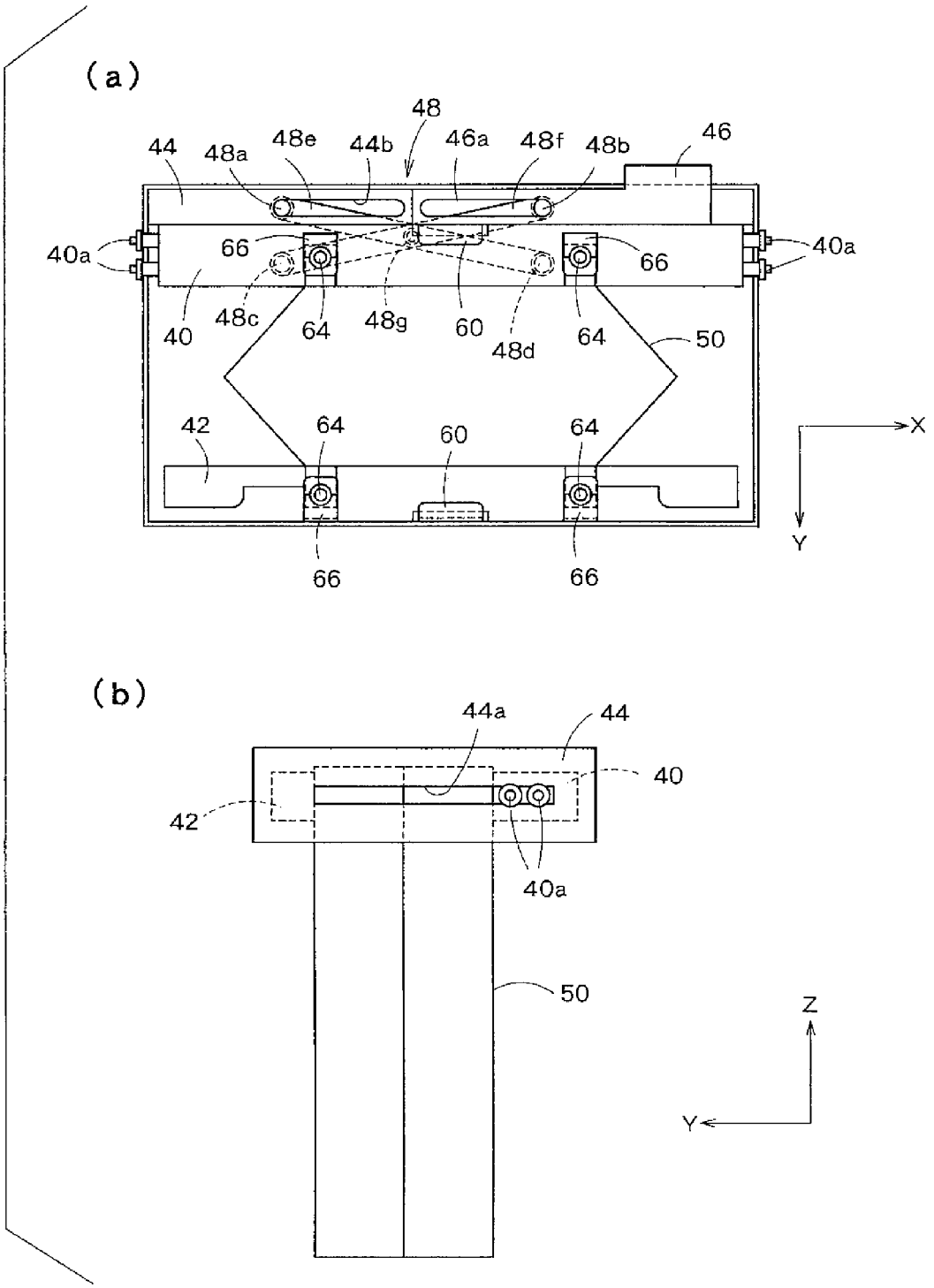
FIG. 7(*a*) is a plan view illustrating a first retention member and a second retention member when the first retention member and the second retention member separate from each other, and FIG. 7(*b*) is a front view illustrating the first retention member and the second retention member when the first retention member and the second retention member separate from each other (when the first retention member and the second retention member in FIG. 7(*a*) are viewed from a right side).
Figure 8:
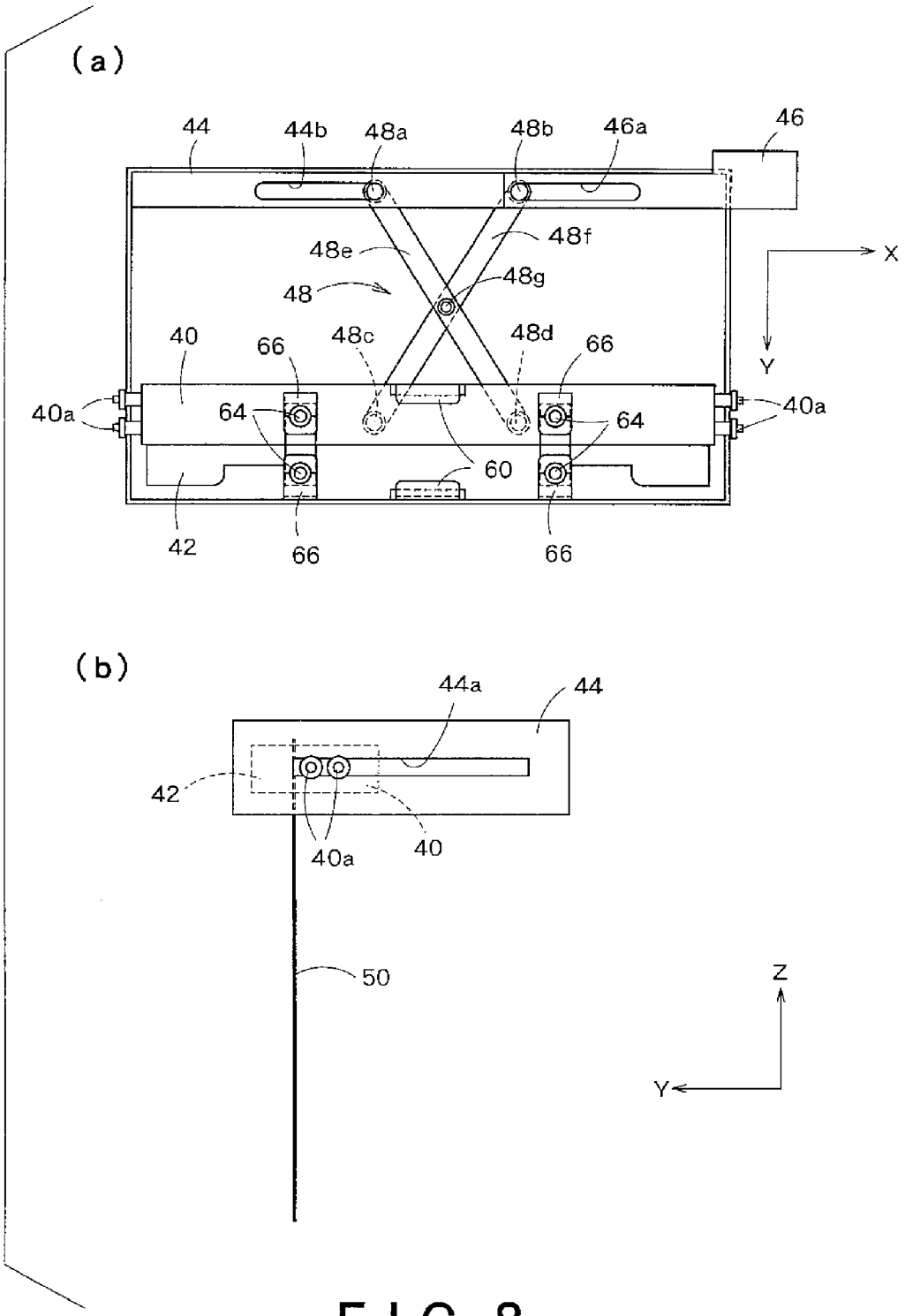
FIG. 8(*a*) is a plan view illustrating the first retention member and the second retention member when the first retention member and the second retention member abut on each other, and FIG. 8(*b*) is a front view illustrating the first retention member and the second retention member when the first retention member and the second retention member abut on each other (when the first retention member and the second retention member in FIG. 8(*a*) are viewed from the right side).

A mechanism that moves the first retention member 40 toward the second retention member 42 will be described below with reference to FIGS. 7 and 8. FIG. 7(*a*) is a plan view illustrating the first retention member 40 and the second retention member 42 when the first retention member 40 and the second retention member 42 separate from each other, and FIG. 7(*b*) is a front view illustrating the first retention member 40 and the second retention member 42 when the first retention member 40 and the second retention member 42 separate from each other (when the first retention member 40 and the second retention member 42 in FIG. 7(*a*) are viewed from the right side). FIG. 8(*a*) is a plan view illustrating the first retention member 40 and the second retention member 42 when the first retention member 40 and the second retention member 42 abut on each other, and FIG. 8(*b*) is a front view illustrating the first retention member 40 and the second retention member 42 when the first retention member 40 and the second retention member 42 abut on each other (when the first retention member 40 and the second retention member 42 in FIG. 8(*a*) are viewed from the right side).

As illustrated in FIGS. 3, 7, and 8, a lever 46 is provided in the first retention member 40, and the operator pulls the lever 46 onto the front side of the chassis 20*a* (the X-direction in FIG. 3). When the operator pulls the lever 46 onto the front side of the chassis 20*a*, the first retention member 40 moves toward the second retention member 42. More particularly, a first expansion and contraction mechanism 48 that can horizontally expand and contract is provided between the first retention member 40 and the lever 46, and the first retention member 40 is attached to a front edge of the first expansion and contraction mechanism 48. For example, the first expansion and contraction mechanism 48 is constructed by a pantograph mechanism. When the operator pulls the lever 46 onto the front side of the chassis 20*a*, the first expansion and contraction mechanism 48 expands from a contract state in FIG. 7(*a*) to become an expansion state in FIG. 8(*a*). At this point, the first retention member 40 moves toward the second retention member 42.

The detailed configurations of the first retention member 40, the second retention member 42, and the first expansion and contraction mechanism 48 will be described below.

As illustrated in FIGS. 7(*b*) and 8(*b*), a horizontally extending elongated opening 44*a* is provided in a side surface of the frame body 44. As illustrated in FIGS. 7(*a*) and 8(*a*), a pair of pin members 40*a* is provided in each of both the end portions of the first retention member 40, and each pin member 40*a* is inserted in the opening 44*a* formed in the side surface of the frame body 44. Each pin member 40*a* moves along the opening 44*a*, whereby the first retention member 40 is movable in the crosswise direction in FIGS. 7(*b*) and 8(*b*), namely, the up-and-down direction in FIGS. 7(*a*) and 8(*a*).

The first expansion and contraction mechanism 48 being the pantograph mechanism includes four pin members 48*a*, 48*b*, 48*c*, and 48*d* that are provided in the end portions. In the four pin members, the first pin member 48*a* and the second pin member 48*b* are provided on the side of the lever 46, and the third pin member 48*c* and the fourth pin member 48*d* are provided on the side of the first retention member 40. The first pin member 48*a* and the fourth pin member 48*d* are provided both the end portions of a first rod-shaped member 48*e*, and the second pin member 48*b* and the third pin member 48*c* are provided both the end portions of a second rod-shaped member 48*f*. The first rod-shaped member 48*e* and the second rod-shaped member 48*f* are connected to each other by a central pin member 48*g* so as to be turnable with respect to each other.

An elongated opening 44*b* is formed near the first retention member 40 in the frame body 44, and the first pin member 48*a* is inserted in the opening 44*b*. The first pin member 48*a* is connected to the lever 46, and the first pin member 48*a* moves toward the right direction in FIG. 7(*a*) within the opening 44*b* when the operator pulls the lever 46 (in this case, the lever 46 moves toward the right direction in FIG. 7(*a*)). An elongated opening 46*a* is provided in the lever 46, and the second pin member 48*b* is inserted in the opening 46*a*. At this point, the second pin member 48*b* is attached to the frame body 44, and the second pin member 48*b* does not move even if the operator pulls the lever 46. In pulling the lever 46, the opening 46*a* moves while the second pin member 48*b* is located in the opening 46*a* of the lever 46. The third pin member 48*c* is provided in the first retention member 40 so as to be movable in the crosswise direction in FIGS. 7(*a*) and 7(*b*) with respect to the first retention member 40. On the other hand, the fourth pin member 48*d* is provided in the first retention member 40 so as not to move with respect to the first retention member 40.

As illustrated in FIG. 7(*a*), when the operator pulls the lever 46 onto the front side of the chassis 20*a* while the first retention member 40 and the second retention member 42 separate from each other, the lever 46 moves toward the right direction in FIG. 7(*a*), and the pin member 48*a* of the first expansion and contraction mechanism 48 also moves toward the right direction in FIG. 7(*a*). Therefore, the first expansion and contraction mechanism 48 expands downward, and the first retention member 40 and the second retention member 42 abut on each other as illustrated in FIG. 8(*a*). When the first retention member 40 and the second retention member 42 abut on each other, the upper opening of the banknote storing bag 50 is sealed as illustrated in FIG. 8(*b*).

A lock mechanism 49 is provided in the frame body 44 of the storing unit 26 in order to lock the frame body 44 in the chassis 20*a*. The second retention member 42 is slightly movable along the movement direction (that is, the up-and-down direction in FIG. 7(*a*)) of the first retention member 40. The first expansion and contraction mechanism 48 expands downward, and the first retention member 40 and the second retention member 42 abut on each other as illustrated in FIG. 8(*a*). Then, by further pulling the lever 46 onto the front side of the chassis 20*a*, the first retention member 40 presses the second retention member 42 to move the second retention member 42. Therefore, the lock mechanism 49 unlocks the frame body 44, and the frame body 44 is drawable onto the front side from the inside of the chassis 20*a*. The first and second retention members 40 and 42 provided in the frame body 44 are drawable onto the front side (the X-direction in FIG. 3) from the inside of the chassis 20*a* to collect the banknote storing bag 50 that is retained by the first retention member 40 and the second retention member 42.

Figure 9:
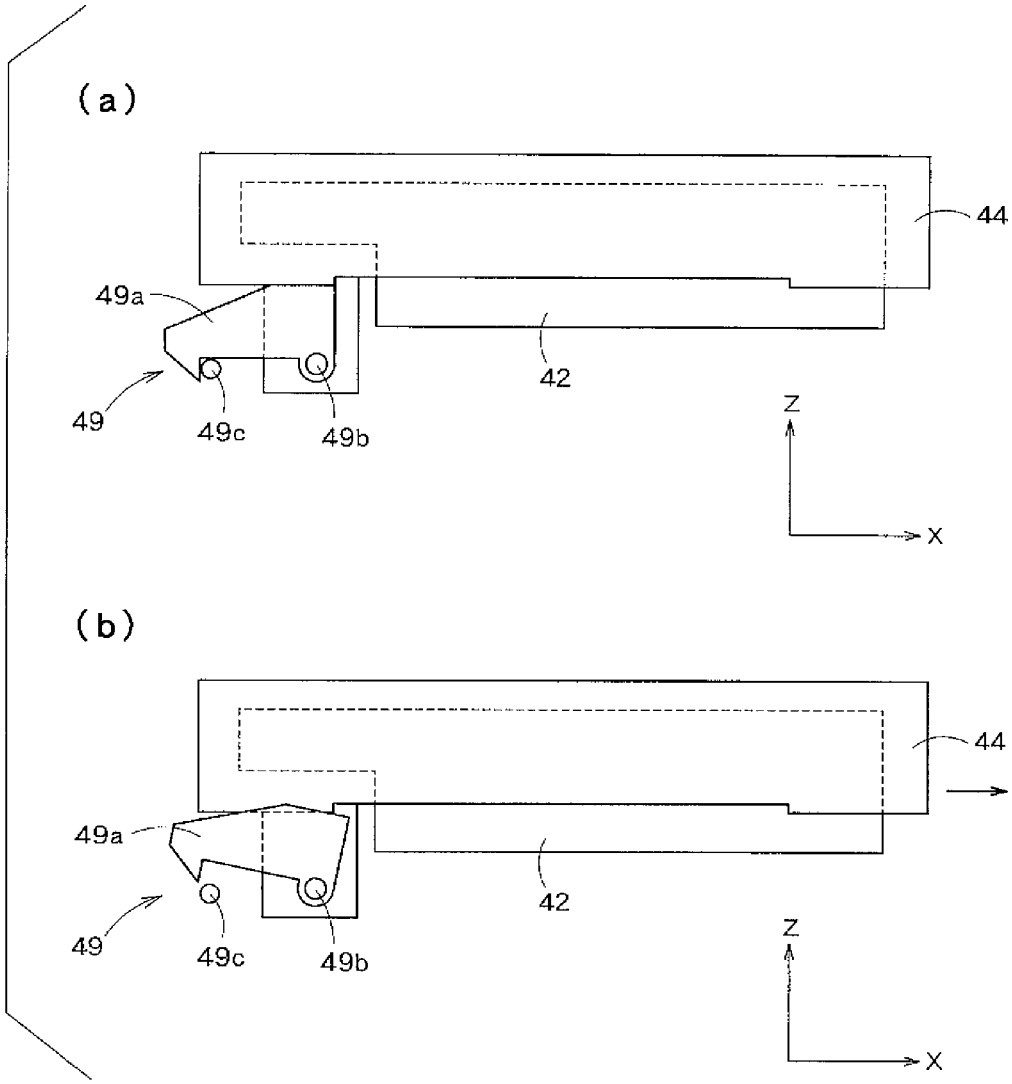
FIG. 9 is a side view illustrating a configuration of a lock mechanism that locks the first retention member and the second retention member in a chassis, FIG. 9(*a*) is a side view illustrating a state in which a frame body is locked by the lock mechanism, and FIG. 9(*b*) is a side view illustrating a state in which the frame body is unlocked by the lock mechanism.

The configuration of the lock mechanism 49 will be described with reference to FIG. 9. FIG. 9 is a side view illustrating the configuration of the lock mechanism 49 that locks the first retention member 40 and the second retention member 42 in the chassis 20*a*, FIG. 9(*a*) is a side view illustrating the state in which the lock mechanism 49 locks the frame body 44, and FIG. 9(*b*) is a side view illustrating the state in which the lock mechanism 49 releases the frame body 44. As illustrated in FIG. 9, the lock mechanism 49 includes a lock member 49*a* that is pivoted on a shaft 49*b* and a lock pin 49*c* on which the lock member 49*a* is hooked. The lock pin 49*c* is attached to a fixed position in the chassis 20*a*. The shaft 49*b* of the lock member 49*a* is attached to the frame body 44. Therefore, in the state in FIG. 9(*a*) in which the lock member 49*a* is hooked on the lock pin 49*c*, the frame body 44 cannot be drawn onto the front side (that is, the right direction in FIG. 9) from the inside of the chassis 20*a*.

A link mechanism (not illustrated) is attached to the lock member 49*a*, and the link mechanism is connected to the lever 46. When the second retention member 42 is pressed by the first retention member 40 to move toward a lower direction in FIG. 8(*a*), the lock member 49*a* turns in a clockwise direction about the shaft 49*b* from the state in FIG. 9(*a*) by the link mechanism connected to the lever 46. When the lock member 49*a* turns in a clockwise direction about the shaft 49*b* from the state in FIG. 9(*a*), the lock member 49*a* falls out of the lock pin 49*c* as illustrated in FIG. 9(*b*). When the lock member 49*a* falls out of the lock pin 49*c*, the frame body 44 is drawable onto the front side (that is, the right direction in FIG. 9) from the inside of the chassis 20*a*.

Figure 10:
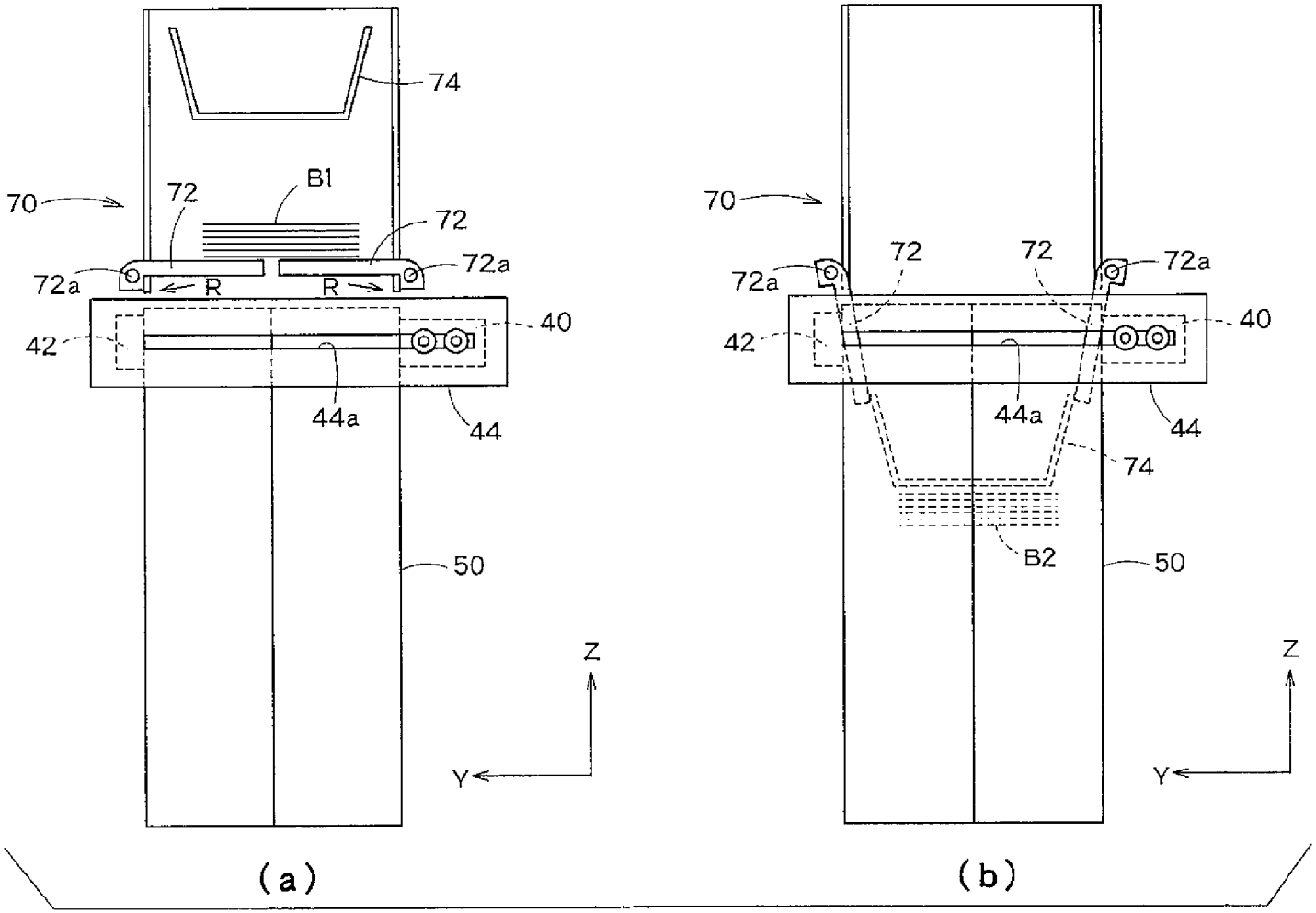
FIG. 10 is a front view illustrating a configuration of a push-in mechanism that pushes a banknote in the banknote storing bag, FIG. 10(*a*) is a front view illustrating the state of the push-in mechanism before the banknote is pushed into the banknote storing bag by the push-in mechanism, and FIG. 10(*b*) is a front view illustrating the state of the push-in mechanism after the banknote is pushed into the banknote storing bag by the push-in mechanism.

A push-in mechanism 70 is provided above the frame body 44 of the storing unit 26 in order to push the banknote in the banknote storing bag 50. The push-in mechanism 70 will be described with reference to FIGS. 10 and 11. FIG. 10(*a*) is a front view illustrating the state of the push-in mechanism 70 before the push-in mechanism 70 pushes the banknote in the banknote storing bag 50, and FIG. 10(*b*) is a front view illustrating the state of the push-in mechanism 70 after the push-in mechanism 70 pushes the banknote in the banknote storing bag 50.

The push-in mechanism 70 includes a pair of escrow plates 72, and the escrow plates 72 are provided above the banknote storing bag 50 placed in the storing unit 26. The escrow plate 72 escrows the banknote, which is transported to the storing unit 26 from the transport unit 23, before the banknote is stored in the banknote storing bag 50. In FIG. 10(*a*), the banknote escrowed by the pair of escrow plates 72 is designated by a reference numeral B1. A push-in plate 74 is provided in the push-in mechanism 70. The push-in plate 74 downwardly presses the banknote escrowed on the escrow plates 72, and pushes the banknote in the banknote storing bag 50.

As illustrated in FIGS. 10(*a*) and 10(*b*), each escrow plate 72 is pivoted on a shaft 72*a*. A torsion spring is provided in each shaft 72*a*. The escrow plate 72 maintains the horizontally extending state when no force is applied to the escrow plate 72. On the other hand, when a downwardly pressing force is applied to the escrow plate 72, the escrow plate 72 turns about the shaft 72*a* against the force of the torsion spring, and is located at the position at which the escrow plate 72 extend downward or obliquely downward from the shaft 72*a*. Thus, each escrow plate 72 moves between a horizontally extending hold position in FIG. 10(*a*) and a release position in FIG. 10(*b*), at which the escrow plate 72 turns about the shaft 72*a* from the hold position to downwardly or obliquely downwardly extend. When the escrow plates 72 are located at the hold position as illustrated in FIG. 10(*a*), the banknote transported to the storing unit 26 from the transport unit 23 is escrowed on the escrow plate 72.

Figure 11:
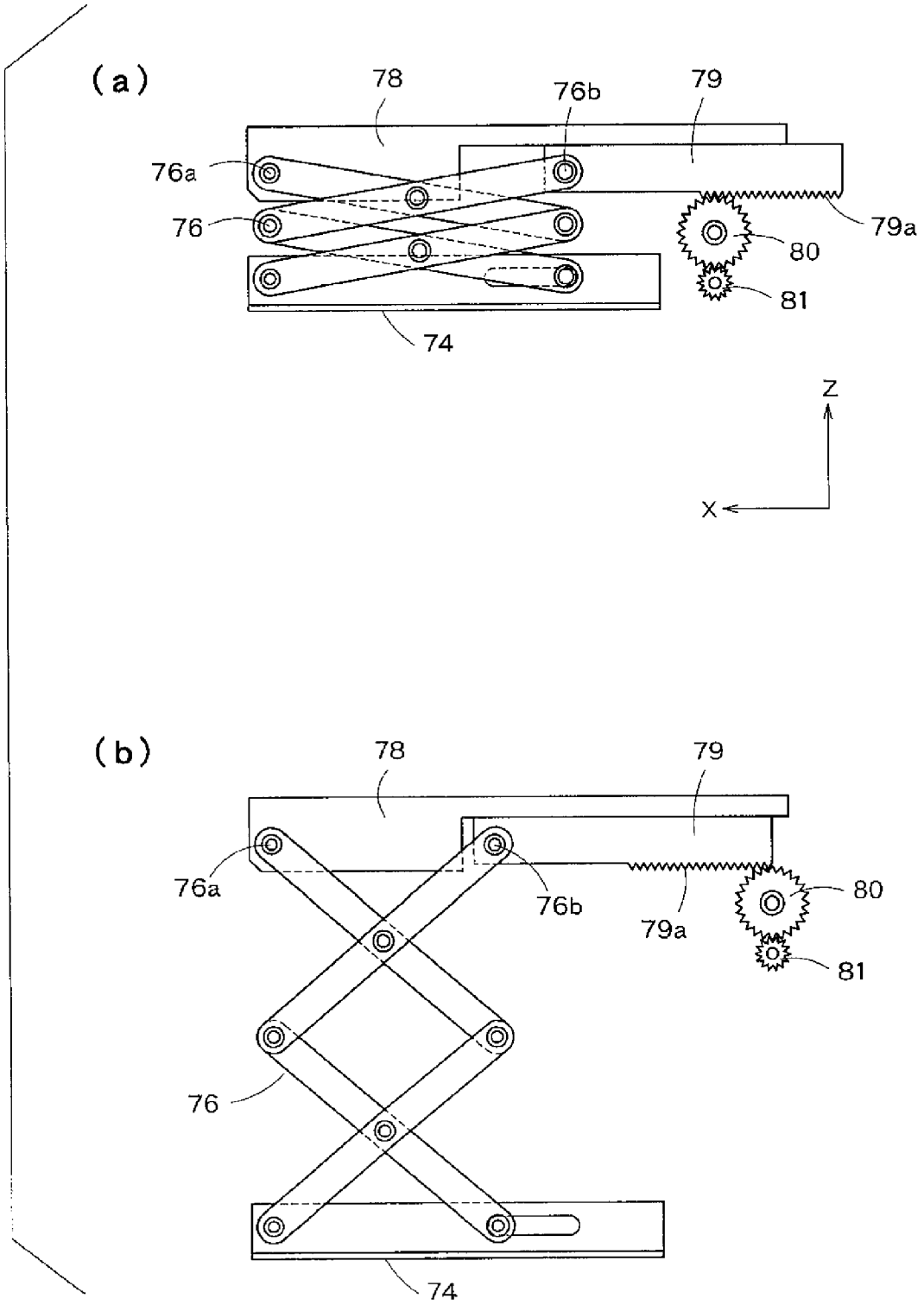
FIG. 11 is a configuration diagram illustrating a configuration of a second expansion and contraction mechanism attached to a push-in plate of the push-in mechanism in FIG. 10, FIG. 11(*a*) is a view illustrating the state in which the second expansion and contraction mechanism contracts, and FIG. 11(*b*) is a view illustrating the state in which the second expansion and contraction mechanism expands.

The push-in plate 74 is movable in the up-and-down direction in FIG. 10. More particularly, as illustrated in Hg. 11, the push-in plate 74 is attached to the front edge of the second expansion and contraction mechanism 76 that can vertically expand and contract. For example, the second expansion and contraction mechanism 76 is constructed by the pantograph mechanism. FIG. 11(*a*) illustrates the state in which the second expansion and contraction mechanism 76 contracts, and FIG. 11(*b*) illustrates the state in which the second expansion and contraction mechanism 76 expands.

As illustrated in FIG. 11, a ceiling member 78 is provided at a fixed position in the upper portion of the second expansion and contraction mechanism 76, and a first pin member 76*a* provided at the upper end of the second expansion and contraction mechanism 76 is attached to the ceiling member 78. A rack mechanism 79 is provided in the ceiling member 78 while being movable in the crosswise direction in FIG. 11. A pinion member 80 is provided in a rack surface 79*a* of the rack mechanism 79, and a gear 81 engages the pinion member 80. A motor (not illustrated) rotates the gear 81, whereby the rack mechanism 79 is moved in the crosswise direction in FIG. 11 by the pinion member 80. A second pin member 76*b* provided at the upper end of the second expansion and contraction mechanism 76 is attached to the end portion of the rack mechanism 79. When the rack mechanism 79 moves toward the left from the state in FIG. 11(*a*), the second pin member 76*b* also moves toward the left, and the second expansion and contraction mechanism 76 expands downward from the ceiling member 78. As illustrated in FIG. 11(*b*), the push-in plate 74 attached to the lower end of the second expansion and contraction mechanism 76 also moves downward.

In this embodiment, as illustrated in FIG. 10(*a*), when the second expansion and contraction mechanism 76 expands downward to move the push-in plate 74 downward while the banknote transported to the storing unit 26 from the transport unit 23 is escrowed on the escrow plates 72 (see a banknote B1 in FIG. 10(*a*)), the push-in plate 74 downwardly presses the banknote on the escrow plates 72, and the escrow plates 72 move to the release position in FIG. 10(*b*) from the hold position in FIG. 10(*a*). Therefore, the push-in plate 74 pushes the banknote on the escrow plates 72 in the banknote storing bag 50 (see a banknote B2 in FIG. 10).

When the escrow plates 72 move to the release position in FIG. 10(*b*) from the hold position in FIG. 10(*a*), the escrow plates 72 close gaps (designated by the reference numeral R in FIG. 10(*a*)) above the first retention member 40 and the second retention member 42 (see FIG. 10(*b*)). Therefore, the banknote escrowed on the escrow plates 72 is stored in the banknote storing bag 50, the banknote can be prevented from invading in the gaps R above the first retention member 40 and the second retention member 42, and the generation of the trouble such as a banknote jam can be prevented in the storing unit 26.

Figure 12:
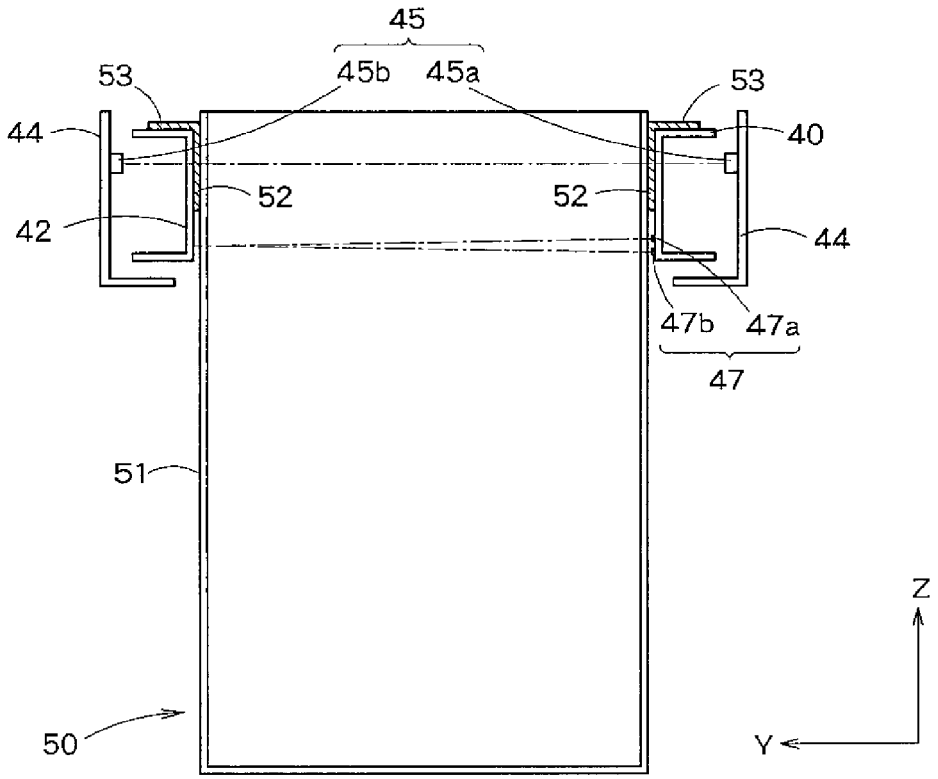
FIG. 12 is a view illustrating a configuration of a paper sheet storing bag detection unit that detects whether a paper sheet storing bag is placed in a storing unit.

In this embodiment, as illustrated in FIG. 12, an optical sensor 45 including a light emitting unit 45*a* and a light receiving unit 45*b* is provided, the light emitting unit 45*a* and the light receiving unit 45*b* are provided in the frame body 44, and light emitted from the light emitting unit 45*a* of the optical sensor 45 is received by the light receiving unit 45*b*. The light emitting unit 45*a* and the light receiving unit 45*b* are provided in the surface on which the retained member 52 of the banknote storing bag 50 abuts when the banknote storing bag 50 is retained by the first retention member 40 and the second retention member 42. For this reason, the light emitted from the light emitting unit 45*a* is received by the light receiving unit 45*b* when the banknote storing bag 50 is not retained by the first retention member 40 and the second retention member 42. On the other hand, when the banknote storing bag 50 is retained by the first retention member 40 and the second retention member 42, the light emitted from the light emitting unit 45*a* is blocked by the retained member 52 made of the material having no optical transparency, and hardly reaches the light receiving unit 45*b*. Thus, the optical sensor 45 including the light emitting unit 45*a* and the light receiving unit 45*b* can detect whether the banknote storing bag 50 is retained by the first retention member 40 and the second retention member 42.

Figure 13:
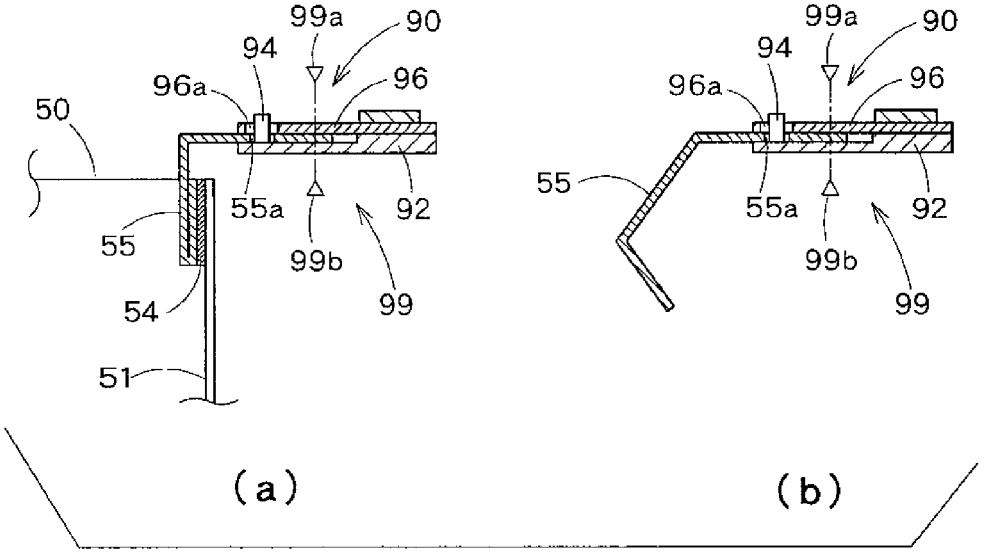
FIG. 13 is a sectional view illustrating a configuration of a peel-off sheet retention member that retains a peel-off sheet attached to an adhesive surface of the banknote storing bag, FIG. 13(*a*) is a sectional view illustrating the state in which the peel-off sheet of the banknote storing bag retained by the first retention member is retained by the peel-off sheet retention member, and FIG. 13(*b*) is a sectional view illustrating the state of the peel-off sheet after the peel-off sheet is peeled off from the banknote storing bag.

In this embodiment, the peel-off sheet retention member 90 is provided in order to retain the peel-off sheet 55. The peel-off sheet 55 is attached to the adhesive surface 54 of the banknote storing bag 50 retained by the first retention member 40 and the second retention member 42. The configuration of the peel-off sheet retention member 90 will be described below with reference to FIGS. 3 and 13. FIG. 13(*a*) is a sectional view illustrating the state in which the peel-off sheet 55 of the banknote storing bag 50 retained by the first retention member 40 is retained by the peel-off sheet retention member 90, and FIG. 13(*b*) is a sectional view illustrating the state in which the peel-off sheet 55 is peeled off from the banknote storing bag 50.

As illustrated in FIG. 3, the peel-off sheet retention member 90 is attached to the frame body 44 in the neighborhood of the first retention member 40. At this point, the peel-off sheet retention member 90 does not move even if the first retention member 40 moves toward the second retention member 42. As illustrated in FIG. 13, the peel-off sheet retention member 90 includes a bottom plate 92 and the peel-off sheet fixing pin 94 that is provided so as to extend upward from the bottom plate 92. A peel-off sheet keep plate 96 is provided on the bottom plate 92, and the operator can manually separate the peel-off sheet keep plate 96 from the bottom plate 92 using a hinge member 98 (see FIG. 3). An opening 96*a* is formed in the peel-off sheet keep plate 96, and the peel-off sheet fixing pin 94 protrudes through the opening 96*a* of the peel-off sheet keep plate 96 when the peel-off sheet keep plate 96 is placed on the bottom plate 92. The operator manually separates the peel-off sheet keep plate 96 from the bottom plate 92, places the front edge of the peel-off sheet 55 on the bottom plate 92 such that the peel-off sheet fixing pin 94 protrudes through the opening 55*a* formed in the peel-off sheet 55 (see FIG. 13(*a*)), and puts the peel-off sheet keep plate 96 on the peel-off sheet 55, whereby the front edge of the peel-off sheet 55 is retained between the bottom plate 92 and the peel-off sheet keep plate 96.

When the first retention member 40 that retains the banknote storing bag 50 moves toward the second retention member 42, the first retention member 40 and the peel-off sheet retention member 90 separate from each other. Therefore, as illustrated in FIG. 13(*b*), the peel-off sheet 55 is peeled off from the banknote storing bag 50 while retained by the peel-off sheet retention member 90. When the first retention member 40 and the second retention member 42 abut on each other, the peel-off sheet 55 is peeled off from the adhesive surface 54 formed in the inner surface of the banknote storing bag 50. Therefore, the upper opening of the banknote storing bag 50 is sealed by the adhesive surface 54.

As illustrated in FIGS. 3 and 13, a peel-off sheet sensor 99 that detects the peel-off sheet 55 retained between the bottom plate 92 and the peel-off sheet keep plate 96 is provided in the peel-off sheet retention member 90. Specifically, for example, the peel-off sheet sensor 99 is an optical sensor, and the light emitted from a light emitting unit 99*a* of the optical sensor is blocked by the peel-off sheet 55 made of the material having no optical transparency and hardly reaches a light receiving unit 99*b*, so that the peel-off sheet sensor 99 can detect that the peel-off sheet 55 is retained by the peel-off sheet retention member 90.

As described above, the end portion on the side of the adhesive surface 54 in the peel-off sheet 55 that should be retained by the peel-off sheet retention member 90 is folded twice in the identical direction, and the front edge portion that is folded twice is attached to the adhesive surface 54 (see FIG. 5). The first retention member 40 that retains the banknote storing bag 50 moves toward the second retention member 42, and the peel-off sheet 55 is peeled off from the banknote storing bag 50 while retained by the peel-off sheet retention member 90. At this point, the peel-off sheet 55 can smoothly be peeled off from the banknote storing bag 50. For example, in the case that the end portion on the side of the adhesive surface 54 in the peel-off sheet 55 is folded only once and attached to the adhesive surface 54, unfortunately the peel-off sheet 55 is hardly peeled off from the banknote storing bag 50 when the first retention member 40 and the peel-off sheet retention member 90 separate from each other. On the other hand, the end portion on the side of the adhesive surface 54 in the peel-off sheet 55 is folded twice in the identical direction, which allows the peel-off sheet 55 to be easily peeled off from the banknote storing bag 50. As described above, the end portion on the side of the adhesive surface 54 in the peel-off sheet 55 is folded only once to form the V-shape, and the folded front edge portion may be attached to the adhesive surface 54. In this case, the portion on the opposite side to the folded front edge portion in the peel-off sheet 55 is folded when the peel-off sheet 55 is retained by the peel-off sheet retention member 90.

In this embodiment, a first-retention-member detection unit 47 is provided in order to detect the position of the first retention member 40 with respect to the second retention member 42 (see FIG. 12). For example, the first-retention-member detection unit 47 is constructed by a light emitting unit 47*a* and a light receiving unit 47*b*. The light emitting unit 47*a* and the light receiving unit 47*b* are provided in the first retention member 40. The light, which is emitted from the light emitting unit 47*a* and reflected by the side surface of the second retention member 42, is received by the light receiving unit 47*b* to detect the distance between the first retention member 40 and the second retention member 42. An opening degree in the upper opening of the banknote storing bag 50 is detected based on the distance, which is detected by the first-retention-member detection unit 47, between the first retention member 40 and the second retention member 42.

A lever detection unit (not illustrated) that detects the position of the lever 46 may be provided instead of the first-retention-member detection unit 47 that detects the position of the first retention member 40 with respect to the second retention member 42. In this case, the opening degree in the upper opening of the banknote storing bag 50 is detected based on the distance between the first retention member 40 and the second retention member 42. The distance is calculated based on the position of the lever 46, and the position of the lever 46 is detected by the lever detection unit. The operator can be informed using the display unit such as the operation/display unit 29 according to the opening degree. When the first retention member 40 moved beyond a certain position, the banknote storing bag 50 is slightly closely attached to have an influence on banknote storing action. In such cases, for example, the display such as "pull the lever to seal the banknote storing bag" is performed to inform the operator can be informed.

The banknote storing action in the storing unit 26 of the banknote cash unit 20 having the above configuration will be described below.

The operator manually places the empty banknote storing bag 50 in the storing unit 26. Specifically, the retained members 52 of the banknote storing bag 50 are retained by the first retention member 40 and the second retention member 42 of the storing unit 26. More particularly, as illustrated in FIG. 6(*a*), when the operator inserts the hook portion 53 provided in each retained member 52 in the gap between the upper surface of the first retention member 40 or the second retention member 42 and the cover member 66, the hook portion 53 rides on the upper surface inclined in the oblique direction in the banknote storing bag fixing pin 64, the banknote storing bag fixing pin 64 is pressed by the hook portion 53 to tentatively retract downward. Then the banknote storing bag fixing pin 64 expands upward again such that the banknote storing bag fixing pin 64 protrudes through the opening 53*a* of the hook portion 53. Therefore, the hook portions 53 of the banknote storing bag 50 are hooked on the first retention member 40 and the second retention member 42. When the banknote storing bag 50 is placed on the storing unit 26, the optical sensor 45 detects that the banknote storing bag 50 is placed on the storing unit 26.

After the banknote storing bag 50 is retained by the first retention member 40 and the second retention member 42, the peel-off sheet 55 attached to the adhesive surface 54 of the banknote storing bag 50 is retained by the peel-off sheet retention member 90. Specifically, the operator manually separates the peel-off sheet keep plate 96 from the bottom plate 92 to cause the peel-off sheet fixing pin 94 extending upward from the bottom plate 92 to protrude through the opening 55*a* of the peel-off sheet 55, whereby the peel-off sheet keep plate 96 is placed on the bottom plate 92 to retain the peel-off sheet 55 between the bottom plate 92 and the peel-off sheet keep plate 96 as illustrated in FIG. 13(*a*). When the peel-off sheet 55 is retained by the peel-off sheet retention member 90, the peel-off sheet sensor 99 detects that the peel-off sheet 55 is retained by the peel-off sheet retention member 90.

When the peel-off sheet 55 attached to the adhesive surface 54 of the banknote storing bag 50 is retained by the peel-off sheet retention member 90 while the banknote storing bag 50 is retained by the first retention member 40 and the second retention member 42, the banknote transported to the storing unit 26 from the transport unit 23 can be stored in the banknote storing bag 50. More specifically, the banknote transported to the storing unit 26 from the transport unit 23 is escrowed on the escrow plate 72 (see the banknote B1 in FIG. 10(*a*)). The banknote escrowed on the escrow plates 72 is pushed into the banknote storing bag 50 by the push-in plate 74. Specifically, as illustrated in FIG. 10(*a*), when the second expansion and contraction mechanism 76 expands downward to move the push-in plate 74 downward while the banknote transported to the storing unit 26 from the transport unit 23 is escrowed on the escrow plates 72, the push-in plate 74 downwardly presses the banknote on the escrow plates 72, and the escrow plates 72 moves to the release position in FIG. 10(*b*) from the hold position in FIG. 10(*a*). Therefore, the push-in plate 74 pushes the banknote on the escrow plates 72 in the banknote storing bag 50 (see a banknote B2 in FIG. 10). When the escrow plates 72 move to the release position in FIG. 10(*b*) from the hold position in FIG. 10(*a*), the escrow plates 72 close gaps (designated by the reference numeral R in FIG. 10(*a*)) above the first retention member 40 and the second retention member 42 (see FIG. 10(*b*)).

After the banknote is stored in the banknote storing bag 50, when the banknote storing bag 50 is taken out from the storing unit 26 to collect the banknote in each banknote storing bag 50, the operator pulls the lever 46 onto the front side of the chassis 20*a*. Therefore, the first expansion and contraction mechanism 48 expands to the expansion state in FIG. 8(*a*) from the contract state in FIG. 7(*a*) and the first retention member 40 and the second retention member 42 abut on each other. When the first retention member 40 that retains the banknote storing bag 50 moves toward the second retention member 42, the first retention member 40 and the peel-off sheet retention member 90 separate from each other. Therefore, as illustrated in FIG. 13(*b*), the peel-off sheet 55 is peeled off from the banknote storing bag 50 while retained by the peel-off sheet retention member 90. When the first retention member 40 and the second retention member 42 abut on each other, the peel-off sheet 55 is peeled off from the adhesive surface 54 formed in the inner surface of the banknote storing bag 50. Therefore, the upper opening of the banknote storing bag 50 is sealed by the adhesive surface 54.

After the first retention member 40 and the second retention member 42 abut on each other as illustrated in FIG. 8(*a*), the operator further pulls the lever 46 onto the front side of the chassis 20*a*, and the first retention member 40 presses the second retention member 42 to move the second retention member 42. Therefore, the lock mechanism 49 unlocks the frame body 44, and the frame body 44 is drawable onto the front side from the inside of the chassis 20*a*. Thus, the operator can draw the first and second retention members 40 and 42 provided in the frame body 44 from the inside of the chassis 20*a*, and the banknote storing bag 50 that is retained by the first and second retention members 40 and 42 while the upper opening is sealed is also drawn onto the front side from the inside of the chassis 20*a*. Then, when the operator downwardly presses the bag unfixing levers 60 provided in the first and second retention members 40 and 42, the pressing section 60*a* connected to the bag unfixing lever 60 downwardly presses the hook section 62*a* of the pin accommodation member 62, and the banknote storing bag fixing pin 64 retracts in the inside of the first retention member 40 or the second retention member 42. Therefore, the banknote storing bag fixing pin 64 falls out of the opening 53*a* of the hook portion 53, and the operator can take out the portion 53 of the banknote storing bag 50 from the first retention member 40 or the second retention member 42. The banknote storing bag 50 in which the upper opening is sealed can be taken out from the first retention member 40 and the second retention member 42, and the banknote storing bag 50 can be collected.

As described above, according to the banknote cash unit 20 of this embodiment, the first retention member 40 and the second retention member 42 are disposed so as to be separately arrayed along the direction (the Y-direction in FIG. 3) orthogonal to the drawing direction (the X-direction in FIG. 3) in which the first retention member 40 and the second retention member 42 are drawn from the inside of the chassis 20*a*, the first retention member 40 is movable toward the second retention member 42 along the direction orthogonal to the drawing direction, and the upper opening of the banknote storing bag 50 is sealed when the first retention member 40 moves toward and abuts on the second retention member 42. The first retention member 40 and the second retention member 42 are drawn to the outside from the inside of the chassis 20*a* only when the first retention member 40 and the second retention member 42 abut on each other. Thus, when the first and second retention members 40 and 42 that retain the banknote storing bag 50 abut on each to seal the upper opening of the banknote storing bag 50, the drawing distance in which the first and second retention members 40 and 42 that retain the banknote storing bag 50 are drawn onto the front side of the banknote cash unit 20 can be shortened to achieve space saving on the front side of the banknote cash unit 20 by moving the first retention member 40 in the direction orthogonal to the drawing direction (the X-direction in FIG. 3) in which the banknote storing bag 50 is drawn to the outside from the inside of the chassis 20*a*.

In the banknote cash unit 20 of this embodiment, the lever 46 is provided in the first retention member 40, and the first retention member 40 moves toward the second retention member 42 when the lever 46 is moved. The first expansion and contraction mechanism 48 that can horizontally expand and contract is provided between the first retention member 40 and the lever 46, and the first retention member 40 is attached to the front edge of the first expansion and contraction mechanism 48. The first expansion and contraction mechanism 48 expands when the lever 46 is moved, and the first retention member 40 moves toward the second retention member 42. At this point, the first expansion and contraction mechanism 48 is constructed by the pantograph mechanism.

In the banknote cash unit 20 of this embodiment, the lock mechanism 49 is provided in the storing unit 26 to lock the first retention member 40 and the second retention member 42 in the chassis 20*a*, and the second retention member 42 is slightly movable along the movement direction of the first retention member 40. When the second retention member 42 presses and moves the first retention member 40, the lock mechanism 49 unlocks the first retention member 40 and the second retention member 42, and the first retention member 40 and the second retention member 42 are drawable to the outside from the inside of the chassis 20*a*.

The banknote cash unit 20 of this embodiment includes the escrow plate 72 and the push-in plate 74. The escrow plate 72 is provided above the banknote storing bag 50 placed in the storing unit 26, and escrows the banknote before the banknote is stored in the banknote storing bag 50. The push-in plate 74 pushes the banknote in the banknote storing bag 50 by downwardly pushing the banknote escrowed on the escrow plate 72. The escrow plate 72 is pivoted on the shaft 72*a*, and the escrow plate 72 moves between the horizontally extending hold position (see FIG. 10(*a*)) and the downwardly or obliquely downwardly extending release position (see FIG. 10(*b*)) to which the escrow plate 72 turns about the shaft 72*a* from the hold position. When the escrow plate 72 is located at the hold position, the banknote transported to the storing unit 26 is escrowed on the escrow plate 72, the push-in plate 74 downwardly presses the banknote on the escrow plate 72 to move the escrow plate 72 to the release position from the hold position, and the banknote on the escrow plate 72 is pushed into the banknote storing bag 50 by the push-in plate 74. Therefore, the banknotes in the banknote storing bag 50 are compressed by the push-in plate 74 every transaction in which the banknote is stored in the banknote storing bag 50, generation of a stacking failure of the banknote is reduced in the banknote storing bag 50, and the storage amount of the banknote stored in the banknote storing bag 50 can be increased.

The push-in plate 74 is attached to the front edge of the second expansion and contraction mechanism 76, which can vertically expand and contract, the second expansion and contraction mechanism 76 expands downward, the push-in plate 74 downwardly presses the banknote on the escrow plate 72, the escrow plate 72 moves to the release position from the hold position, and the banknote on the escrow plate 72 is pushed into the banknote storing bag 50 by the push-in plate 74.

When moving to the release position from the hold position, the escrow plates 72 close the gaps above the first retention member 40 and the second retention member 42. Therefore, when the banknote escrowed on the escrow plates 72 is stored in the banknote storing bag 50, the banknote can be prevented from invading in the gaps R above the first retention member 40 and the second retention member 42, and the generation of the trouble such as the banknote jam can be prevented in the storing unit 26.

The banknote storing bag detection unit is provided in the banknote cash unit 20 of this embodiment in order to detect whether the banknote storing bag 50 is placed in the storing unit 26. For example, the optical sensor 45 is used as the banknote storing bag detection unit.

In the banknote cash unit 20 of this embodiment, the retained members 52 retained by the first retention member 40 and the second retention member 42 are provided in the banknote storing bag 50, and the banknote storing bag detection unit detects the retained member 52. Specifically, the retained member 52 is made of the material having no optical transparency, and the banknote storing bag detection unit is the optical sensor 45. When the banknote storing bag 50 is placed in the storing unit 26, the light emitted from the light emitting unit 45*a* of the optical sensor 45 is blocked by the retained member 52 made of the material having no optical transparency and hardly reaches the light receiving unit 45*b*, so that the banknote storing bag detection unit can detect that the banknote storing bag 50 is placed in the storing unit 26.

In the banknote cash unit 20 of this embodiment, the opening 53*a* is provided in the hook portion 53 of the retained member 52. The banknote storing bag fixing pins 64 are provided in the first retention member 40 and the second retention member 42. When the banknote storing bag 50 is placed in the storing unit 26, the banknote storing bag fixing pin 64 protrudes through the opening 53*a* of the hook portion 53 provided in the retained member 52 of the banknote storing bag 50. The opening 53*a* of the hook portion 53 provided in the retained member 52 of the banknote storing bag 50 is hooked on the banknote storing bag fixing pin 64, whereby the banknote storing bag 50 is retained by the first retention member 40 and the second retention member 42. At this point, the banknote storing bag fixing pins 64 are provided so as to extend upward from the upper surfaces of the first retention member 40 and the second retention member 42 (see FIG. 6(*a*)). The banknote storing bag fixing pins 64 is retractable in the first retention member 40 and the second retention member 42, and the banknote storing bag fixing pins 64 retract in the first retention member 40 and the second retention member 42 to release the banknote storing bag 50 from the first retention member 40 and the second retention member 42.

The first-retention-member detection unit 47 that detects the position of the first retention member 40 with respect to the second retention member 42 is provided in the banknote cash unit 20 of this embodiment, and the opening degree of the banknote storing bag 50 is detected based on the distance, which is detected by the first-retention-member detection unit 47, between the first retention member 40 and the second retention member 42. As described above, instead of the first-retention-member detection unit 47, the opening degree of the banknote storing bag 50 may be detected by a lever detection unit that detects the position of the lever 46. The operator can be informed using the display unit such as the operation/display unit 29 according to the opening degree. When the first retention member 40 moved beyond a certain position, the banknote storing bag 50 is slightly closely attached to have an influence on banknote storing action. In such cases, for example, the display such as "pull the lever to seal the banknote storing bag" is performed to inform the operator can be informed.

According to the banknote cash unit 20 of this embodiment, the first and second retention members 40 and 42 that retain the banknote storing bag 50 while the upper opening of the banknote storing bag 50 is opened and the peel-off sheet retention member 90 that retains the peel-off sheet 55 attached to the adhesive surface 54 of the banknote storing bag 50 retained by the first and second retention members 40 and 42 are provided, and the peel-off sheet 55 is peeled off from the banknote storing bag 50 while retained by the peel-off sheet retention member 90 when the first retention member 40 that retains the banknote storing bag 50 moves to seal the upper opening of the banknote storing bag 50. When the banknote is stored in the banknote storing bag 50, the peel-off sheet 55 is attached to the adhesive surface 54, whereby exposure of the adhesive surface 54 of the banknote storing bag 50 is reduced in storing the banknote. Therefore, when the banknote is stored in the banknote storing bag 50, the banknote can be prevented from adhering to the adhesive surface 54, and the upper opening of the banknote storing bag 50 can surely be sealed by reducing degradation of the adhesive force of the adhesive surface 54. Additionally, the peel-off sheet 55 can easily be peeled off from the adhesive surface 54 only by moving the first retention member 40.

In the banknote cash unit 20 of this embodiment, the first retention member 40 and the second retention member 42 are integrally drawable to the outside from the inside of the chassis 20*a* while retaining the banknote storing bag 50, the first retention member 40 and the second retention member 42 are disposed so as to be separately arrayed along the direction (the Y-direction in FIG. 3) orthogonal to the drawing direction (the X-direction in FIG. 3) in which the first retention member 40 and the second retention member 42 are drawn to the outside from the inside of the chassis 20*a*, and the first retention member 40 is movable toward the second retention member 42 along the direction orthogonal to the drawing direction.

In the banknote cash unit 20 of this embodiment, the peel-off sheet sensor 99 is provided in order to detect the peel-off sheet 55 retained by the peel-off sheet retention member 90. Therefore, whether the peel-off sheet 55 is retained by the peel-off sheet retention member 90 is detectable.

In the banknote cash unit 20 of this embodiment, the end portion on the side of the adhesive surface 54 in the peel-off sheet 55 that should be retained by the peel-off sheet retention member 90 is folded at least once, and the folded front edge portion is attached to the adhesive surface 54 of the banknote storing bag 50. The first retention member 40 that retains the banknote storing bag 50 moves toward the second retention member 42, and the peel-off sheet 55 is peeled off from the banknote storing bag 50 while retained by the peel-off sheet retention member 90. At this point, the peel-off sheet 55 can smoothly be peeled off from the adhesive surface 54 of the banknote storing bag 50.

In the banknote storing method for storing the banknote in the banknote storing bag 50 of this embodiment, the banknote storing bag 50 is retained by the first retention member 40 and the second retention member 42, and the peel-off sheet 55 attached to the adhesive surface 54 of the banknote storing bag 50 is retained by the peel-off sheet retention member 90. Then, the first retention member 40 that retains the banknote storing bag 50 is moved to seal the upper opening of the banknote storing bag 50. At this point, the peel-off sheet 55 is peeled off from the banknote storing bag 50 while retained by the peel-off sheet retention member 90.

The paper sheet storing unit of the first embodiment is not limited to the first embodiment, but various changes can be made. For example, the paper sheet storing unit of the first embodiment is not limited to the paper sheet storing unit provided in the backyard area. The paper sheet except the banknote may be stored in the paper sheet storing unit of the first embodiment. In such cases, the paper sheet storing bag in which the paper sheet is stored is detachably placed in the storing unit.

The first and second retention members that retain the paper sheet storing bag are not limited to the disposition in which the first and second retention members are separately arrayed along the direction orthogonal to the drawing direction in which the first and second retention members are drawn from the inside of the paper sheet storing unit as illustrated in FIG. 3. Alternatively, the first and second retention members that retain the paper sheet storing bag may be disposed so as to be separately arrayed along the drawing direction in which the first and second retention members are drawn from the chassis. In this case, the first retention member is movable toward the second retention member along the drawing direction, the upper opening of the paper sheet storing bag is sealed when the first retention member moves to abut on the second retention member. At this point, the peel-off sheet is peeled off from the paper sheet storing bag while retained by the peel-off sheet retention member.

Second Embodiment

Figure 17:
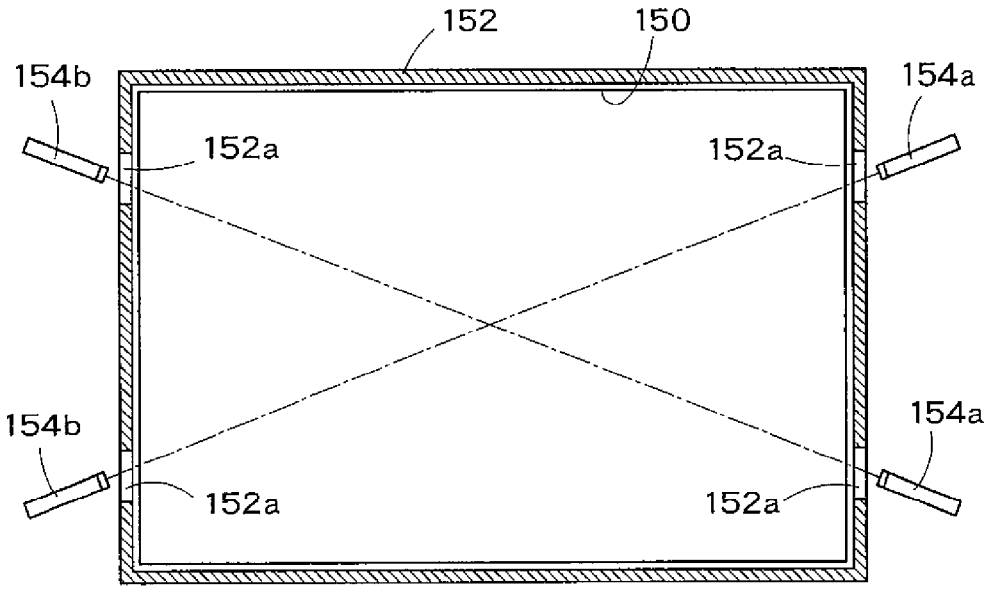
FIG. 17 is a plan view illustrating configurations of the banknote storing bag box in FIG. 14 etc. and a storage state sensor.
Figure 18:
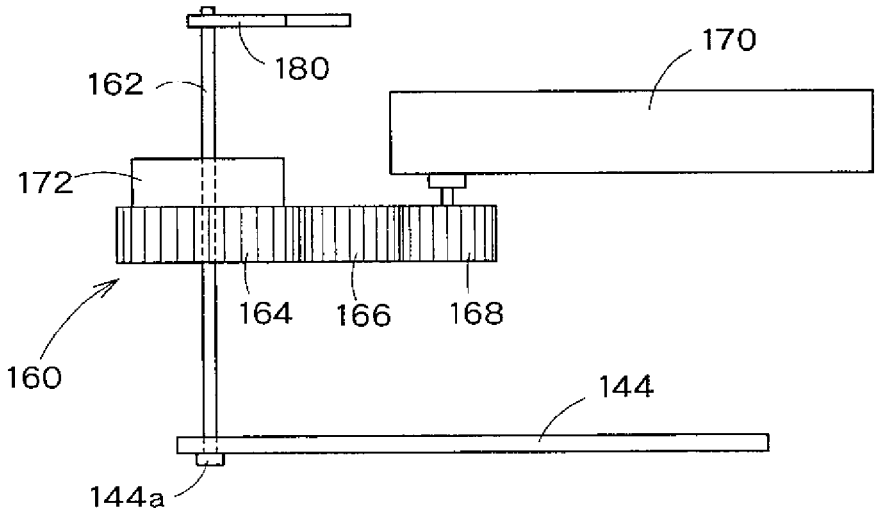
FIG. 18 is a plan view illustrating a configuration of an expansion and contraction mechanism driving unit that drives the expansion and contraction mechanism of the push-in unit in FIG. 14 etc.
Figure 19:
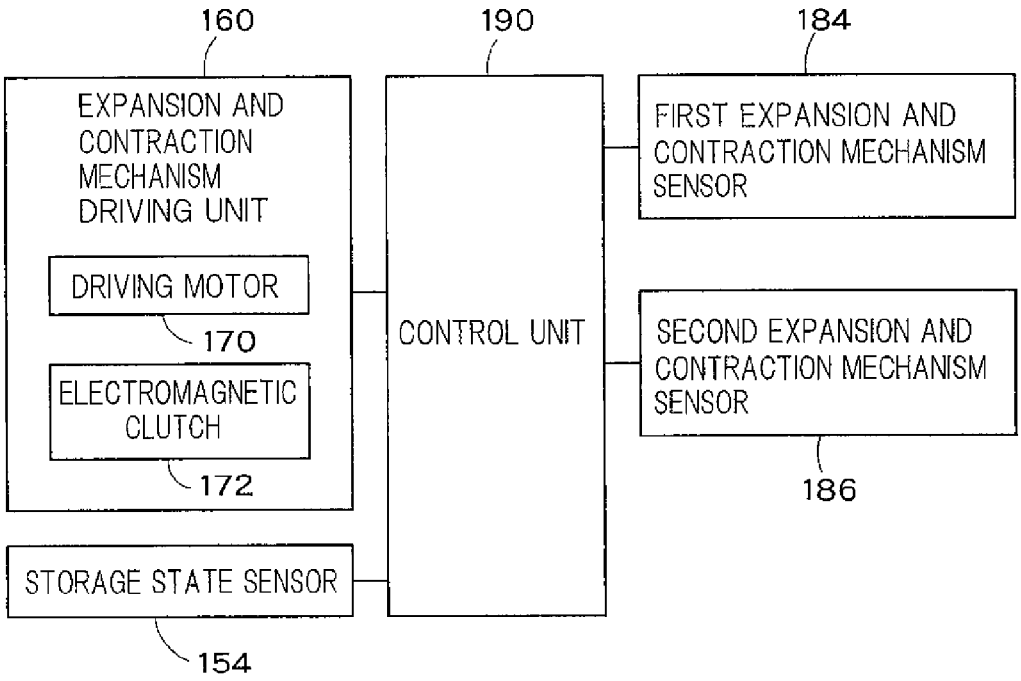
FIG. 19 is a functional block diagram in the banknote cash unit of the second embodiment of the present invention.

A second embodiment of the present invention will be described below with reference to the drawings. FIGS. 14 to 19 are views illustrating a banknote cash unit according to the second embodiment. More particularly, FIGS. 14 to 18 are views illustrating the configuration of the storing unit provided in the banknote cash unit of the second embodiment. FIG. 19 is a functional block diagram in the banknote cash unit of the second embodiment. Instead of the storing unit 26 of the first embodiment, a storing unit 126 having a configuration different from that of the storing unit 26 is used in the banknote cash unit of the second embodiment.

The detailed configuration of the storing unit 126 in the banknote cash unit of the second embodiment will be described below with reference to FIGS. 14 to 18.

In the banknote cash unit 20 of the second embodiment, a banknote storing bag 150 in which the banknote is stored is detachably attached to the storing unit 126, and the banknote transported to the storing unit 126 from the transport unit 23 (see FIG. 2) is stored in the banknote storing bag 150 placed in the storing unit 126.

Figure 14:
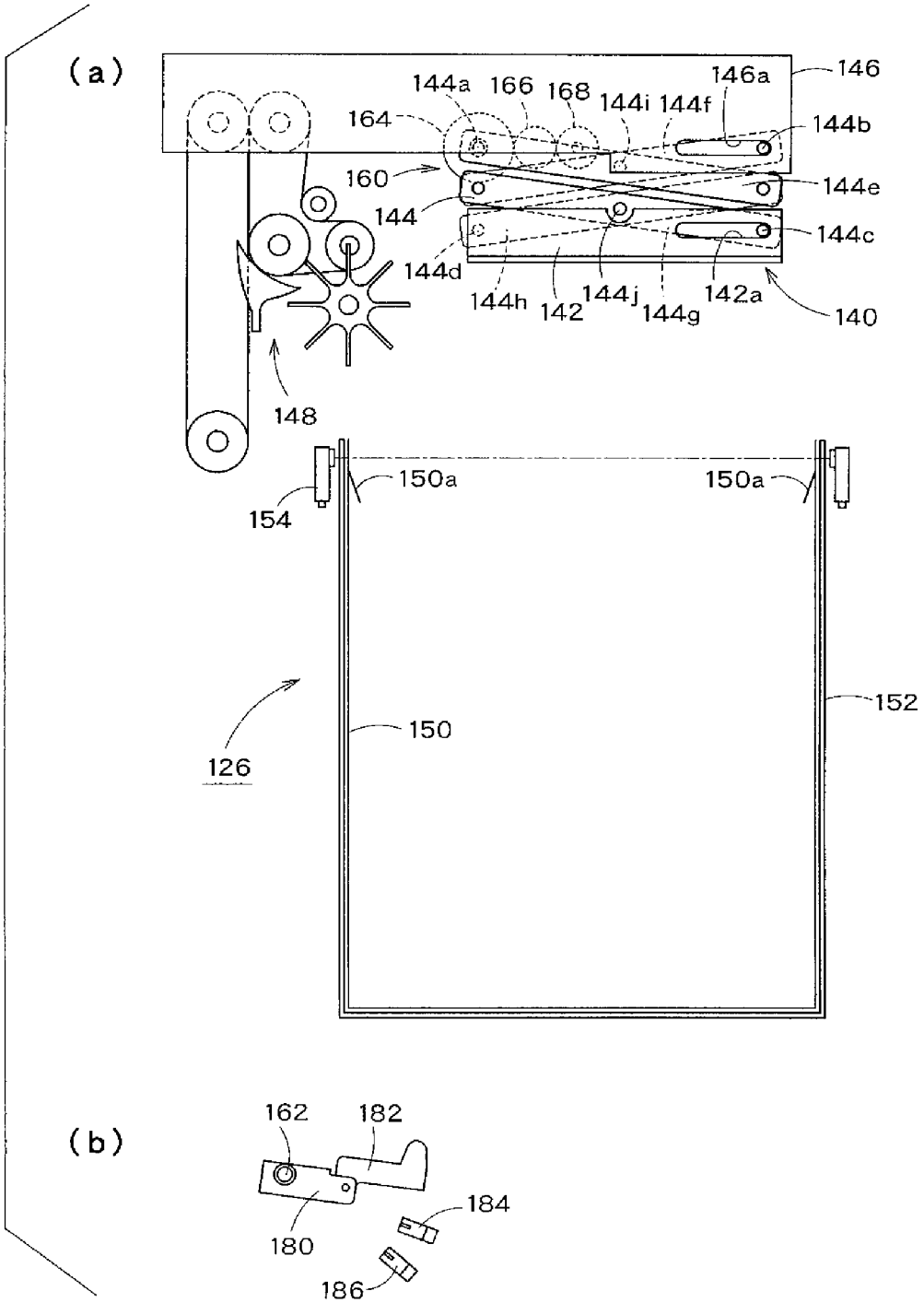
FIG. 14(*a*) is a configuration diagram illustrating configurations of a banknote storing bag box and a push-in unit, which are provided in a storing unit of a banknote cash unit according to a second embodiment of the present invention, and illustrating the state in which an expansion and contraction mechanism of a push-in unit contracts, and FIG. 14(*b*) is an explanatory view illustrating a position of a detected member when the expansion and contraction mechanism of the push-in unit contracts.

More particularly, as illustrated in FIGS. 14(*a*) to 16(*a*), the storing unit 126 includes a banknote storing bag box 152 that accommodates the banknote storing bag 150 while the upper opening of the banknote storing bag 150 is opened. A banknote take-in mechanism 148 is provided above the banknote storing bag box 152 in the storing unit 126, the banknote transported to the storing unit 126 from the transport unit 23 is taken in one by one by the banknote take-in mechanism 148, and the banknote is stored in the banknote storing bag 150 by free fall. A push-in unit 140 is provided in the storing unit 126 in order to push the banknote in the banknote storing bag 150 placed in the banknote storing bag box 152. The push-in unit 140 is placed above the banknote storing bag box 152. A storage state sensor 154 is provided in the storing unit 126. When the banknotes stored in the banknote storing bag 150 reach a storage limit position (a fully stored state or substantially fully stored state), the storage state sensor 154 detects the storage limit position.

Each component constituting the storing unit 126 will be described below in detail.

Figure 15:
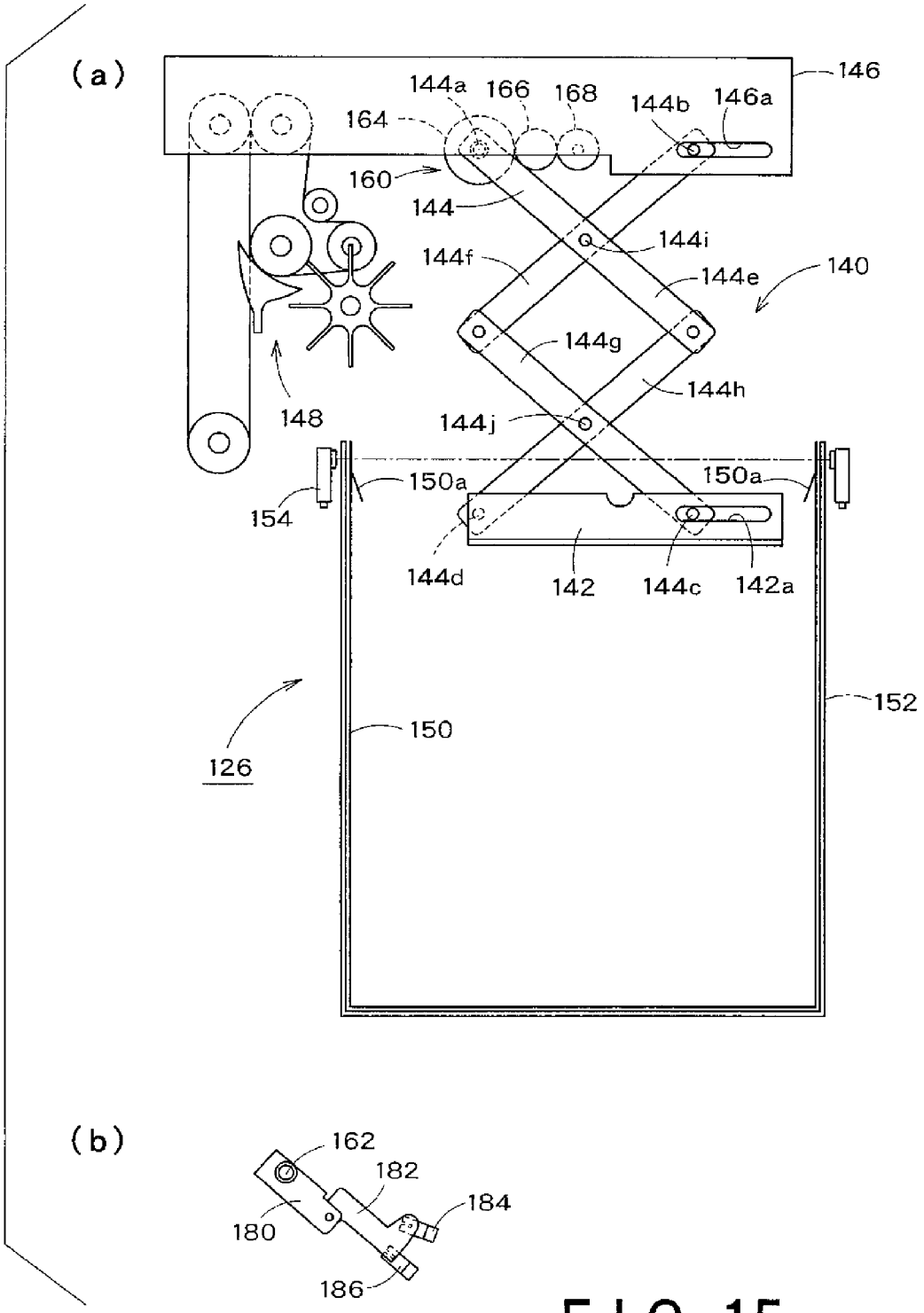
FIG. 15(*a*) is a configuration diagram illustrating the configurations of the banknote storing bag box and the push-in unit, which are provided in the storing unit of the banknote cash unit according to the second embodiment of the present invention, and illustrating the state in which the expansion and contraction mechanism of the push-in unit contracts, and FIG. 15(*b*) is an explanatory view illustrating the position of the detected member when the expansion and contraction mechanism of the push-in unit contracts.
Figure 16:
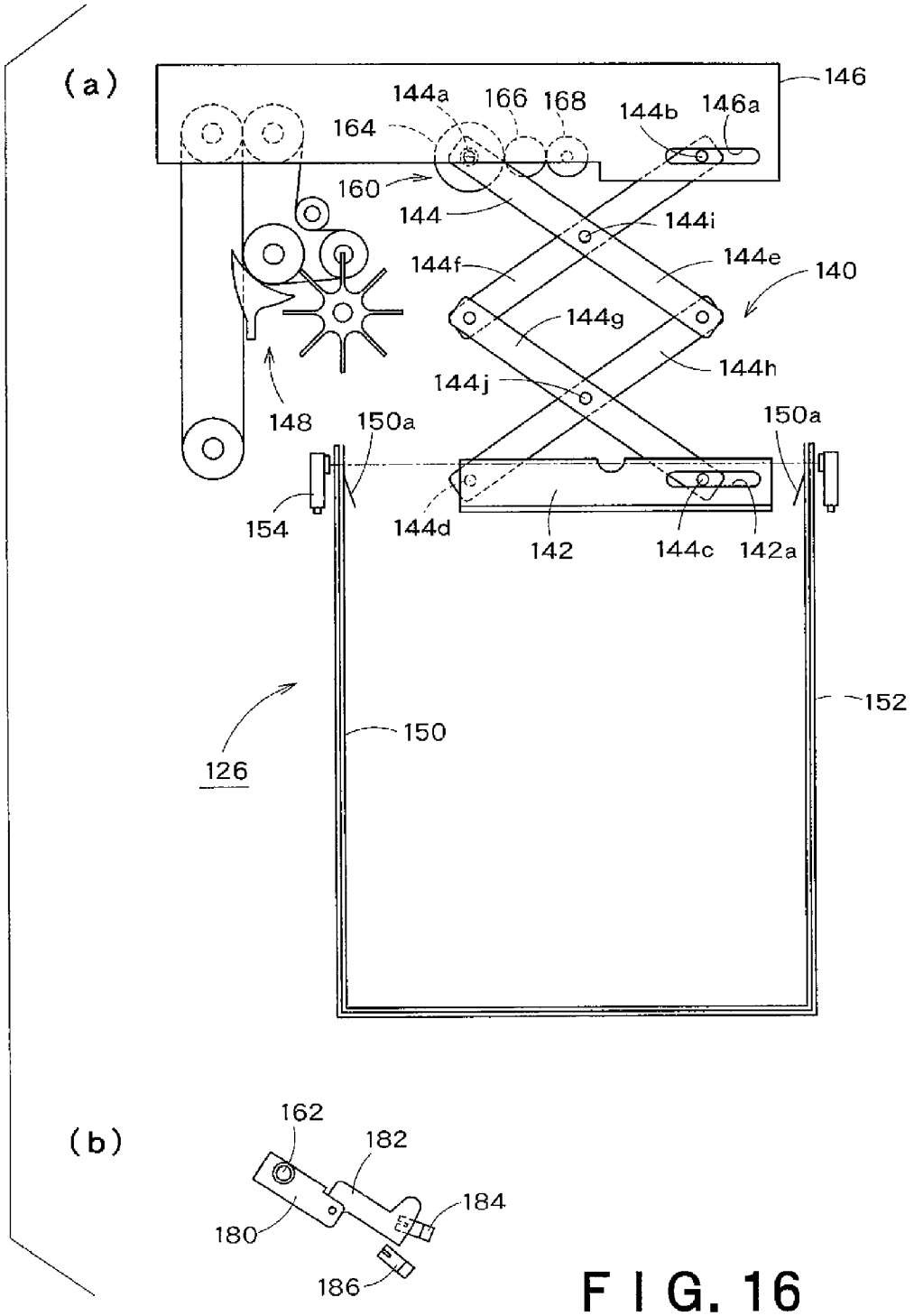
FIG. 16(*a*) is a configuration diagram illustrating the configurations of the banknote storing bag box and the push-in unit, which are provided in the storing unit of the banknote cash unit according to the second embodiment of the present invention, and illustrating the state in which the expansion and contraction mechanism can incompletely expand downward because the banknotes are fully or substantially fully stored in the banknote storing bag to abut a push-in member on the banknotes in the banknote storing bag, and FIG. 16(*b*) is an explanatory view illustrating the position of the detected member when the expansion and contraction mechanism can incompletely expand downward.

The configuration of the banknote storing bag box 152 in which the banknote storing bag 150 is placed will be described with reference to FIGS. 14 to 17. As illustrated in FIGS. 14 to 17, the banknote storing bag box 152 is formed into a substantially rectangular solid shape, and the upper portion of the banknote storing bag box 152 is opened. A storage state sensor 154 is provided outside of the banknote storing bag box 152 and in the upper portion of the banknote storing bag box 152. The storage state sensor 154 detects the banknote storage state of the banknote storing bag 150 placed in the banknote storing bag box 152. Specifically, as illustrated in FIG. 17, the storage state sensor 154 includes a light emitting unit 154*a* and a light receiving unit 154*b*, and the light emitted from the light emitting unit 154*a* is received by the light receiving unit 154*b*. The two sets of storage state sensors 154 each of which includes the light emitting unit 154*a* and the light receiving unit 154*b* are provided, and the pieces of light emitted from the light emitting units 154*a* intersect each other as illustrated in FIG. 17. As illustrated in FIG. 17, an opening 152*a* through which the light emitted from the light emitting unit 154*a* protrudes is formed in the side surface of the banknote storing bag box 152.

For example, the banknote storing bag 150 placed in the banknote storing bag box 152 is made of the transparent or translucent vinyl resin. The banknote storing bag 150 may be painted in black or the like such that the banknote stored in the banknote storing bag 150 is not seen from the outside. The antistatic finish is performed to the inner surface of the banknote storing bag 150. The wedge is provided in the bottom portion of the banknote storing bag 150, thereby increasing the banknote storage amount of the banknote storing bag 150. As illustrated in FIG. 14(*a*), a protrusion 150*a* that protrudes obliquely downward in the banknote storing bag 150 is provided in the inner surface of the banknote storing bag 150. The protrusion 150*a* is formed in the inner surface near the upper opening of the banknote storing bag 150. The protrusion 150*a* is provided below a route (expressed by an alternate long and short dash line in FIGS. 14(*a*) to 16(*a*)) of the light emitted from the light emitting unit 154*a* of the storage state sensor 154. The provision of the protrusion 150*a* can prevent an upright state of the banknote located at the end in the banknotes stored in the banknote storing bag 150, and the storage state sensor 154 can previously be prevented from falsely detecting the banknote in the upright state.

The configuration of the push-in unit 140 that pushes the banknote in the banknote storing bag 150 accommodated in the banknote storing bag box 152 will be described below. The push-in unit 140 includes an expansion and contraction mechanism 144, which can vertically expand and contract, and a push-in member 142 that is attached to the lower end of the expansion and contraction mechanism 144. For example, the push-in member 142 includes a plate-like bottom plate extending in the horizontal direction. The expansion and contraction mechanism 144 is constructed by the pantograph mechanism. A ceiling member 146 is provided in the storing unit 126, and the upper end of the expansion and contraction mechanism 144 is connected to the ceiling member 146. FIG. 14(*a*) illustrates the state in which the expansion and contraction mechanism 144 contracts, and FIG. 15(*a*) illustrates the state in which the expansion and contraction mechanism 144 completely expands downward. FIG. 16(*a*) illustrates the state in which the banknotes are fully or substantially fully stored in the banknote storing bag 150, and the state in which the expansion and contraction mechanism 144 can incompletely expand downward because the push-in member 142 abuts on the banknotes in the banknote storing bag 150. As illustrated in FIG. 15(*a*), when the expansion and contraction mechanism 144 completely expands downward, the push-in member 142 enters the banknote storing bag 150. Therefore, when the expansion and contraction mechanism 144 becomes the expansion state in FIG. 15(*a*) from the contraction state in FIG. 14(*a*), the banknotes in the banknote storing bag 150 are pushed below the push-in member 142.

The detailed configuration of the expansion and contraction mechanism 144 will be described below. A first pin member 144*a* and a second pin member 144*b* are provided at the upper end of the expansion and contraction mechanism 144, and the first pin member 144*a* and the second pin member 144*b* are connected to the ceiling member 146. More particularly, as illustrated in FIG. 18, the first pin member 144*a* is connected to a shaft 162 of an expansion and contraction mechanism driving unit 160 provided in the ceiling member 146, and the first pin member 144*a* is rotated by the expansion and contraction mechanism driving unit 160. The detailed configuration of the expansion and contraction mechanism driving unit 160 is described later. An elongated opening 146*a* extending in the horizontal direction is provided in the ceiling member 146, and the second pin member 144*b* is inserted in the opening 146*a*. The second pin member 144*b* is horizontally movable along the extending direction of the opening 146*a*.

A third pin member 144*c* and a fourth pin member 144*d* are provided at the lower end of the expansion and contraction mechanism 144, and the third pin member 144*c* and the fourth pin member 144*d* are connected to the push-in member 142. More particularly, an elongated opening 142*a* extending in the horizontal direction is formed in the push-in member 142, and the third pin member 144*c* is inserted in the opening 142*a*. The third pin member 144*c* is horizontally movable along the extending direction of the opening 142*a*. On the other hand, the fourth pin member 144*d* is rotatably connected to a predetermined position of the push-in member 142, and the fourth pin member 144*d* does not move with respect to the push-in member 142.

As illustrated in FIGS. 14(*a*) to 16(*a*), the expansion and contraction mechanism 144 includes four rod-shaped members 144*e*, 144*f*, 144*g*, and 144*h*, the first rod-shaped member 144*e* and the second rod-shaped member 144*f* are turnably connected to each other by a central pin member 144*i*, and the third rod-shaped member 144*g* and the fourth rod-shaped member 144*h* are turnably connected to each other by a central pin member 144*j*. The first pin member 144*a* is provided at the upper end of the first rod-shaped member 144*e*, the second pin member 144*b* is provided at the upper end of the second rod-shaped member 144*f*, the third pin member 144*c* is provided at the lower end of the third rod-shaped member 144*g*, and the fourth pin member 144*d* is provided at the lower end of the fourth rod-shaped member 144*h*. The lower end of the first rod-shaped member 144*e* and the upper end of the fourth rod-shaped member 144*h* are turnably connected to each other by a pin member, and the lower end of the second rod-shaped member 144*f* and the upper end of the third rod-shaped member 144*g* are turnably connected to each other by a pin member.

In the configuration of the expansion and contraction mechanism 144, when the first pin member 144*a* rotates in the clockwise direction in FIG. 14(*a*) while the expansion and contraction mechanism 144 completely contracts as illustrated in FIG. 14(*a*), the second pin member 144*b* moves toward the left direction in FIG. 14(*a*) in the opening 146*a*, and the expansion and contraction mechanism 144 expands downward from the ceiling member 146 as illustrated in FIG. 15(*a*). At this point, the third pin member 144*c* also moves toward the left direction in FIG. 14 in the opening 142*a*. On the other hand, when the first pin member 144*a* rotates in the counterclockwise direction in FIG. 15(*a*) while the expansion and contraction mechanism 144 completely expands as illustrated in FIG. 15(*a*), the second pin member 144*b* moves toward the right direction in FIG. 15 in the opening 146*a*, and the expansion and contraction mechanism 144 completely contracts as illustrated in FIG. 14(*a*). At this point, the third pin member 144*c* also moves toward the right direction in FIG. 15(*a*) in the opening 142*a*.

The configuration of the expansion and contraction mechanism driving unit 160 that drives the expansion and contraction mechanism 144 will be described below with reference to FIG. 18. As illustrated in FIG. 14(*a*), the expansion and contraction mechanism driving unit 160 is placed in the ceiling member 146. As described above, the first pin member 144*a* is connected to the shaft 162 of the expansion and contraction mechanism driving unit 160, and the first pin member 144*a* is normally and reversely rotated by the shaft 162. As illustrated in FIG. 18, the expansion and contraction mechanism driving unit 160 includes three gears 164, 166, and 168. The first gear 164 is provided on the shaft 162, the second gear 166 engages the first gear 164, and the third gear 168 engages the second gear 166. The third gear 168 is connected to a driving motor 170, and the third gear 168 is normally and reversely rotated by the driving motor 170. A torque of the driving motor 170 is transmitted to the shaft 162 through the first to third gears 164, 166, and 168, and the first pin member 144*a* of the expansion and contraction mechanism 144 is normally and reversely rotated by the shaft 162.

As illustrated in FIG. 18, an electromagnetic clutch 172 is attached to the first gear 164, and the driving motor 170 is locked or slipping is generated between the electromagnetic clutch 172 and the first gear 164 when the torque exceeding a predetermined torque is applied to the shaft 162. Therefore, when the expansion and contraction mechanism 144 expands downward from the contraction state in FIG. 14(*a*) while the banknotes are fully or substantially fully stored in the banknote storing bag 150, the push-in member 142 abuts on the banknotes stored in the banknote storing bag 150 before the expansion and contraction mechanism 144 completely expands, and the expansion and contraction mechanism 144 cannot expand downward any more (see FIG. 16(*a*)). In this case, the torque exceeding the predetermined torque is applied to the shaft 162 by the driving force of the driving motor 170, the driving motor 170 is locked or the slipping is generated between the electromagnetic clutch 172 and the first gear 164. Thus, the driving force of the driving motor 170 is not transmitted to the shaft 162. In the case that electric outage is generated while the push-in member 142 enters the banknote storing bag 150, a force is applied to the shaft 162 by a spring (not illustrated) connected to a rotating member 180 such that the expansion and contraction mechanism 144 becomes the contraction state in FIG. 14(*a*). Therefore, the push-in member 142 that enters the banknote storing bag 150 retracts upward from the banknote storing bag 150.

As illustrated in FIG. 18, the rotating member 180 that rotates about the shaft 162 is attached to the end portion on the opposite side to the end portion in which the first pin member 144*a* is provided with respect to the shaft 162. The rotating member 180 rotates normally and reversely about the shaft 162 in synchronization with the rotation of the shaft 162. That is, the rotating member 180 rotates about the shaft 162 in conjunction with the expansion and contraction action of the expansion and contraction mechanism 144. As illustrated in FIGS. 14(*b*) to 16(*b*), a detected member 182 is attached to the front edge of the rotating member 180. A first expansion and contraction mechanism sensor 184 and a second expansion and contraction mechanism sensor 186 are provided at fixed positions near the rotating member 180, and the first expansion and contraction mechanism sensor 184 and the second expansion and contraction mechanism sensor 186 detects the detected member 182. Each of the first expansion and contraction mechanism sensor 184 and the second expansion and contraction mechanism sensor 186 is constructed by the optical sensor.

FIG. 14(*b*) illustrates the positions of the rotating member 180 and the detected member 182 when the expansion and contraction mechanism 144 contracts, and FIG. 15(*b*) illustrates the positions of the rotating member 180 and the detected member 182 when the expansion and contraction mechanism 144 completely expands downward. FIG. 16(*b*) illustrates the state in which the banknotes are fully or substantially fully stored in the banknote storing bag 150, and the positions of the rotating member 180 and the detected member 182 when the expansion and contraction mechanism 144 can incompletely expand downward because the push-in member 142 abuts on the banknotes in the banknote storing bag 150.

As illustrated in FIG. 14(*b*), the first expansion and contraction mechanism sensor 184 and the second expansion and contraction mechanism sensor 186 do not detect the detected member 182 when the expansion and contraction mechanism 144 contracts. As illustrated in FIG. 15(*b*), each of the first expansion and contraction mechanism sensor 184 and the second expansion and contraction mechanism sensor 186 detects the detected member 182 when the expansion and contraction mechanism 144 completely expands. As illustrated in FIG. 16(*b*), when the expansion and contraction mechanism 144 can incompletely expand downward because the push-in member 142 abuts on the banknotes in the banknote storing bag 150, the first expansion and contraction mechanism sensor 184 detects the detected member 182 while the second expansion and contraction mechanism sensor 186 does not detect the detected member 182. The first expansion and contraction mechanism sensor 184 detects the detected member 182 in the process in which the expansion and contraction mechanism 144 expands downward from the contraction state, and the second expansion and contraction mechanism sensor 186 detects the detected member 182 when the expansion and contraction mechanism 144 completely expands.

A control unit 190 is provided in the banknote cash unit of the second embodiment, and the push-in unit 140 is controlled by the control unit 190. Specifically, the control unit 190 transmits a command signal to the driving motor 170 of the expansion and contraction mechanism driving unit 160 to control the action of the expansion and contraction mechanism 144 of the push-in unit 140. FIG. 19 is a functional block diagram in the banknote cash unit of the second embodiment of the present invention. As illustrated in FIG. 19, the control unit 190 is connected to the driving motor 170 of the expansion and contraction mechanism driving unit 160, the storage state sensor 154, the first expansion and contraction mechanism sensor 184, and the second expansion and contraction mechanism sensor 186. When the storage state sensor 154 detects that the banknotes stored in the banknote storing bag 150 reach the storage limit position, or when the first expansion and contraction mechanism sensor 184 or the second expansion and contraction mechanism sensor 186 detects the detected member 182, a detection signal is transmitted to the control unit 190 from each of the sensors 154, 184, 186. The control unit 190 transmits the command signal to the driving motor 170 of the expansion and contraction mechanism driving unit 160 based on the detection signal transmitted from each of the sensors 154, 184, 186.

Specifically, when the storage state sensor 154 detects that the banknotes stored in the banknote storing bag 150 reach the storage limit position, the banknote take-in mechanism 148 stops the take-in of the banknote. At this point, the control unit 190 transmits the command signal to the driving motor 170 of the expansion and contraction mechanism driving unit 160 to downwardly expand the expansion and contraction mechanism 144 from the state in FIG. 14(*a*). Therefore, the banknotes in the banknote storing bag 150 are downwardly pushed by the push-in member 142 attached to the lower end of the expansion and contraction mechanism 144. When the storage state sensor 154 does not detect the banknote after the push-in member 142 downwardly pushes the banknotes in the banknote storing bag 150, a storage space for the banknote is seemed to be formed in the banknote storing bag 150, the banknote take-in mechanism 148 resumes the take-in of the banknote, and the banknote is stored in the banknote storing bag 150 again.

On the other hand, when the storage state sensor 154 detects that the banknotes stored in the banknote storing bag 150 still remains in the storage limit position after the push-in member 142 downwardly pushes the banknotes in the banknote storing bag 150, the control unit 190 determines that the banknote storage state of the banknote storing bag 150 reaches a storage limit. As used herein, "the banknote storage state of the banknote storing bag 150 reaches a storage limit" means the state in which the banknote cannot be stored in the banknote storing bag 150 anymore. Even if the control unit 190 determines that the banknote storage state of the banknote storing bag 150 reaches the storage limit, the control unit 190 may transmit the command signal to the driving motor 170 of the expansion and contraction mechanism driving unit 160 again to repeat the action in which the push-in member 142 pushes the banknotes in the banknote storing bag 150 one or a plenty of times. This is attributed to the following fact. That is, in the one-time push-in action performed by the push-in member 142, the banknotes are insufficiently pushed into the banknote storing bag 150, and the storage state sensor 154 detects the banknote. On the other hand, the banknotes are sufficiently compressed in the banknote storing bag 150 by repeating the push-in action of the push-in member 142, and sometimes the storage space for the banknote is formed in the banknote storing bag 150.

As illustrated in FIG. 16(*b*), when the first expansion and contraction mechanism sensor 184 detects the detected member 182 while the second expansion and contraction mechanism sensor 186 does not detect the detected member 182, the control unit 190 determines that the banknote storage state of the banknote storing bag 150 reaches the storage limit. That is, in the state in which the expansion and contraction mechanism 144 incompletely expands downward as illustrated in FIG. 16(*a*), it is considered that the banknotes are fully or substantially fully stored in the banknote storing bag 150, and that the push-in member 142 abuts on the banknote in the banknote storing bag 150 and cannot push the banknote downward anymore.

In this case, as described above, after the control unit 190 determines that the banknote storage state of the banknote storing bag 150 reaches the storage limit, the control unit 190 may control the expansion and contraction mechanism 144 again to repeat the action, in which the push-in member 142 pushes the banknotes in the banknote storing bag 150 by expanding the expansion and contraction mechanism 144 again after the contraction, one or a plenty of times. This is attributed to the following fact. That is, even if the banknotes are insufficiently pushed in the banknote storing bag 150 in the one-time push-in action performed by the push-in member 142, and the push-in member 142 abuts on the banknote in the banknote storing bag 150 and cannot push the banknote downward anymore, the banknotes are sufficiently compressed in the banknote storing bag 150 by repeating the push-in action of the push-in member 142, and sometimes the storage space for the banknote is formed in the banknote storing bag 150.

The banknote storage action in the storing unit 126 of the banknote cash unit of the second embodiment will be described below.

The operator manually places the empty banknote storing bag 150 in the banknote storing bag box 152. When the banknote storing bag 150 is placed in the banknote storing bag box 152, the banknote transported to the storing unit 126 from the transport unit 23 (see FIG. 2) can be stored in the banknote storing bag 150. Specifically, the banknote is transported one by one to the banknote take-in mechanism 148 from the transport unit 23, and the banknote take-in mechanism 148 takes in the banknote one by one, whereby the banknote is stored in the banknote storing bag 150 by the free fall. At this point, the expansion and contraction mechanism 144 of the push-in unit 140 becomes the contraction state as illustrated in FIG. 14(*a*), and the push-in member 142 upwardly separates from the banknote storing bag 150.

Then, the banknotes are sufficiently stored in the banknote storing bag 150, and the banknote take-in mechanism 148 stops the take-in of the banknote when the storage state sensor 154 detects that the banknotes stored in the banknote storing bag 150 reach the storage limit position. At this point, the control unit 190 transmits the command signal to the driving motor 170 of the expansion and contraction mechanism driving unit 160 to downwardly expand the expansion and contraction mechanism 144 from the state in FIG. 14(*a*). Therefore, the banknotes in the banknote storing bag 150 are downwardly pushed by the push-in member 142 attached to the lower end of the expansion and contraction mechanism 144. The compression of the banknotes in the banknote storing bag 150 can form the storage space for the banknote, and eliminate the stacking failure of the banknotes in the banknote storing bag 150. When the storage state sensor 154 does not detect the banknote after the push-in member 142 downwardly pushes the banknotes in the banknote storing bag 150, a storage space for the banknote is seemed to be formed in the banknote storing bag 150, the banknote take-in mechanism 148 resumes the take-in of the banknote, and the banknote is stored in the banknote storing bag 150 again.

When the expansion and contraction mechanism 144 expands downward from the state in FIG. 14(*a*) to become the completely expanding state in FIG. 15(*a*), the first expansion and contraction mechanism sensor 184 and the second expansion and contraction mechanism sensor 186 detects the detected member 182 (FIG. 15(*b*)). At this point, the control unit 190 determines that the storage space for the banknote still exists in the banknote storing bag 150.

On the other hand, when the storage state sensor 154 detects that the banknotes stored in the banknote storing bag 150 still remains in the storage limit position after the push-in member 142 downwardly pushes the banknotes in the banknote storing bag 150, the control unit 190 determines that the banknote storage state of the banknote storing bag 150 reaches the storage limit. In this case, using an information unit (not illustrated), the control unit 190 informs the operator of the information indicating that the banknote storage state of the banknote storing bag 150 reaches the storage limit in a display or sound manner. Specifically, for example, the control unit 190 causes the operation/display unit 29 to display the information indicating that the banknote storage state of the banknote storing bag 150 reaches the storage limit. Even if the control unit 190 determines that the banknote storage state of the banknote storing bag 150 reaches the storage limit, the control unit 190 may transmit the command signal to the driving motor 170 of the expansion and contraction mechanism driving unit 160 again to repeat the action in which the push-in member 142 pushes the banknotes in the banknote storing bag 150 one or a plenty of times. The push-in member 142 repeatedly performs the push-in action to sufficiently compress the banknotes in the banknote storing bag 150, and the storage space for the banknote is formed in the banknote storing bag 150. At this point, the storage state sensor 154 does not detects the banknote, but the banknote take-in mechanism 148 resumes the take-in of the banknote to store the banknote in the banknote storing bag 150 again.

When the banknote storage state of the banknote storing bag 150 reaches the storage limit, the push-in member 142 abuts on the banknotes in the banknote storing bag 150 but the banknotes cannot pushed downward any more. Therefore, the expansion and contraction mechanism 144 can incompletely expand (see FIG. 16(*a*)). At this point, the first expansion and contraction mechanism sensor 184 detects the detected member 182 while the second expansion and contraction mechanism sensor 186 does not detect the detected member 182 (FIG. 16(*b*)). In this case, the control unit 190 determines that the banknote storage state of the banknote storing bag 150 reaches the storage limit, and the control unit 190 informs the operator of the information indicating that the banknote storage state of the banknote storing bag 150 reaches the storage limit in the display or sound manner using the information unit (not illustrated).

In this case, after the control unit 190 determines that the banknote storage state of the banknote storing bag 150 reaches the storage limit, the control unit 190 may control the expansion and contraction mechanism 144 again to repeat the action, in which the push-in member 142 pushes the banknotes in the banknote storing bag 150 by expanding the expansion and contraction mechanism 144 again after the contraction, one or a plenty of times. The push-in member 142 repeatedly performs the push-in action to sufficiently compress the banknotes in the banknote storing bag 150, and the storage space for the banknote is formed in the banknote storing bag 150. At this point, the storage state sensor 154 does not detects the banknote, but the banknote take-in mechanism 148 resumes the take-in of the banknote to store the banknote in the banknote storing bag 150 again.

As described above, according to the banknote cash unit of the second embodiment, the push-in unit 140 is provided in order to push the banknotes in the banknote storing bag 150 placed in the storing unit 126. Accordingly, the push-in unit 140 can compress the banknotes in the banknote storing bag 150 every time the banknote is stored in the banknote storing bag 150, and the generation of the stacking failure of the banknote can be reduced in the banknote storing bag 150. Therefore, the storage amount of the paper sheet stored in the banknote storing bag 150 can be increased.

In the banknote cash unit of the second embodiment, the push-in unit 140 pushes the banknote in the banknote storing bag 150 by downwardly pressing the banknote. More particularly, the push-in unit 140 includes the vertically extending expansion and contraction mechanism 144 and the push-in member 142 that is attached to the front edge of the expansion and contraction mechanism 144, and the expansion and contraction mechanism 144 expands downward, whereby the push-in member 142 pushes the banknote in the banknote storing bag 150. At this point, the expansion and contraction mechanism 144 is constructed by the pantograph mechanism. When the expansion and contraction mechanism 144 completely expands, the push-in member 142 enters the banknote storing bag 150 placed in the storing unit 126. When the expansion and contraction mechanism 144 completely expands, the push-in member 142 enters the banknote storing bag 150, which allows the banknote to be surely compressed in the banknote storing bag 150.

The storage state sensor 154 that detects the banknotes stored in the banknote storing bag 150 reach the storage limit position and the control unit 190 that controls the push-in unit 140 are provided in the banknote cash unit of the second embodiment. When the storage state sensor 154 that detects that the banknotes stored in the banknote storing bag 150 reach the storage limit position, the control unit 190 controls the push-in unit 140 such that the push-in unit 140 pushes the banknote in the banknote storing bag 150. At this point, when the storage state sensor 154 detects that the banknotes stored in the banknote storing bag 150 still remains in the storage limit position after the push-in unit 140 pushes the banknotes in the banknote storing bag 150, the control unit 190 determines that the banknote storage state of the banknote storing bag 150 reaches a storage limit. When determining that the banknote storage state of the banknote storing bag 150 reaches a storage limit, the control unit 190 controls the push-in unit 140 again to repeat the action in which the push-in unit 140 pushes the banknote in the banknote storing bag 150 one or a plenty of times.

In the banknote cash unit of the second embodiment, the control unit 190 controls the expansion and contraction mechanism 144 of the push-in unit 140, and the rotating member 180 and the detected member 182, which rotates in conjunction with the expansion and contraction action of the expansion and contraction mechanism 144, are attached to the expansion and contraction mechanism 144. The first and second expansion and contraction mechanism sensors 184 and 186 that detect the detected member 182 are provided in the storing unit 126. The first expansion and contraction mechanism sensor 184 detects the detected member 182 in the process in which the expansion and contraction mechanism 144 expands downward from the contraction state, and the second expansion and contraction mechanism sensor 186 detects the detected member 182 when the expansion and contraction mechanism 144 completely expands. When the first expansion and contraction mechanism sensor 184 detects the detected member 182 while the second expansion and contraction mechanism sensor 186 does not detect the detected member 182, the control unit 190 determines that the banknote storage state of the banknote storing bag 150 reaches the storage limit. After determining that the banknote storage state of the banknote storing bag 150 reaches the storage limit, the control unit 190 controls the expansion and contraction mechanism 144 again to repeat the action, in which the push-in member 142 pushes the banknotes in the banknote storing bag 150 by expanding the expansion and contraction mechanism 144 again after the contraction, one or a plenty of times.

In the banknote cash unit of the second embodiment, the protrusion 50*a* that protrudes obliquely downward in the banknote storing bag 150 is provided in the banknote storing bag 150 placed in the storing unit 126. The provision of the protrusion 150*a* can prevent an upright state of the banknote located at the end in the banknotes stored in the banknote storing bag 150, and the storage state sensor 154 can previously be prevented from falsely detecting the banknote in the upright state.

The paper sheet storing unit of the second embodiment is not limited to the second embodiment, but various changes can be made. For example, the paper sheet storing unit of the second embodiment is not limited to the paper sheet storing unit provided in the backyard area. The paper sheet except the banknote may be stored in the paper sheet storing unit of the second embodiment. In such cases, the paper sheet storing bag in which the paper sheet is stored is detachably placed in the storing unit.

The push-in unit that pushes the paper sheet into the paper sheet storing bag placed in the storing unit is not limited to the push-in unit in which the push-in member is attached to the front edge of the expansion and contraction mechanism such as the pantograph mechanism. A mechanism except the mechanism including the push-in member and the expansion and contraction mechanism can be used as long as the paper sheet can be pushed into the paper sheet storing bag.

The invention claimed is:

1. A paper sheet storing unit comprising:

a take-in unit that takes a paper sheet into the paper sheet storing unit; and a storing unit in which a paper sheet storing bag to store the paper sheet is detachably placed, the storing unit storing the paper sheet taken into the paper sheet storing unit by the take-in unit, wherein the storing unit includes a first retention member and a second retention member, the first retention member and the second retention member retaining the paper sheet storing bag while an upper opening of the paper sheet storing bag is opened, the first retention member and the second retention member are separately placed in an identical plane while the paper sheet storing bag is retained between the first retention member and the second retention member, and the first retention member and the second retention member are disposed so as to be separately arrayed along a direction orthogonal to a drawing direction in which the first retention member and the second retention member are drawn from the paper sheet storing unit, the first retention member is movable toward the second retention member along the direction orthogonal to the drawing direction, and the upper opening of the paper sheet storing bag is sealed when the first retention member moves toward and abuts on the second retention member, whereby the first retention member and the second retention member can be integrally drawn to an outside from the paper sheet storing unit while retaining the paper sheet storing bag, after sealing the upper opening of the paper sheet storing bag, a lock mechanism that locks the first retention member and the second retention member in the paper sheet storing unit is provided to the storing unit, and the second retention member is slightly movable along a movement direction of the first retention member, and when the second retention member moves by press of the first retention member, the lock mechanism is unlocked, then the first retention member and the second retention member is drawable to the outside from the paper sheet storing unit.

2. The paper sheet storing unit according to claim 1, wherein a lever is provided to the first retention member, and the first retention member moves toward the second retention member when the lever is moved.

3. The paper sheet storing unit according to claim 2, wherein a first expansion and contraction mechanism, which can horizontally expand and contract, is provided between the first retention member and the lever, the first retention member is attached to a front edge of the first expansion and contraction mechanism, and the first expansion and contraction mechanism expands when the lever is moved, then the first retention member moves toward the second retention member.

4. The paper sheet storing unit according to claim 3, wherein the first expansion and contraction mechanism is a pantograph mechanism.

5. The paper sheet storing unit according to claim 1, further comprising a paper sheet storing bag detection unit that detects whether the paper sheet storing bag is placed in the storing unit.

6. The paper sheet storing unit according to claim 5, wherein a retained member that is retained by each of the first retention member and the second retention member is provided to the paper sheet storing bag, and the paper sheet storing bag detection unit detects the retained member.

7. The paper sheet storing unit according to claim 6, wherein the retained member is made of a material having no optical transparency, and the paper sheet storing bag detection unit is an optical sensor.

8. The paper sheet storing unit according to claim 1, further comprising a first-retention-member detection unit that detects a position of the first retention member with respect to the second retention member, wherein an opening degree of the paper sheet storing bag is detected based on a distance between the first retention member and the second retention member, the distance detected by the first-retention-member detection unit.

9. The paper sheet storing unit according to claim 2, further comprising a lever detection unit that detects a position of the lever, wherein an opening degree of the paper sheet storing bag is detected based on a distance between the first retention member and the second retention member, the distance calculated based on the position of the lever detected by the lever detection unit.

10. A paper sheet storing unit comprising:

a take-in unit that takes a paper sheet into the paper sheet storing unit;

a storing unit in which a paper sheet storing bag to store the paper sheet is detachably placed, the storing unit storing the paper sheet taken into the paper sheet storing unit by the take-in unit;

an escrow plate that is provided above the paper sheet storing bag placed in the storing unit, and that escrows the paper sheet before the paper sheet transported to the storing unit is stored in the paper sheet storing bag; and a push-in plate that pushes the paper sheet escrowed on the escrow plate into the paper sheet storing bag by downwardly pressing the paper sheet, wherein the storing unit includes a first retention member and a second retention member, the first retention member and the second retention member retaining the paper sheet storing bag while an upper opening of the paper sheet storing bag is opened, the first retention member and the second retention member are separately placed in an identical plane while the paper sheet storing bag is retained between the first retention member and the second retention member, the first retention member and the second retention member can be integrally drawn to an outside from the paper sheet storing unit while retaining the paper sheet storing bag, and the first retention member and the second retention member are disposed so as to be separately arrayed along a direction orthogonal to a drawing direction in which the first retention member and the second retention member are drawn from the paper sheet storing unit, the first retention member is movable toward the second retention member along the direction orthogonal to the drawing direction, and the upper opening of the paper sheet storing bag is sealed when the first retention member moves toward and abuts on the second retention member, wherein the escrow plate is pivoted on a shaft, the escrow plate moves between a horizontally extending hold position and a downwardly or obliquely downwardly extending release position, to which the escrow plate turns about the shaft from the hold position, and the paper sheet transported to the storing unit is escrowed on the escrow plate when the escrow plate is located at the hold position, the push-in plate downwardly presses the paper sheet on the escrow plate to move the escrow plate to the release position from the hold position, then the paper sheet on the escrow plate is pushed into the paper sheet storing bag by the push-in plate.

11. The paper sheet storing unit according to claim 10, wherein the push-in plate is attached to a front edge of a second expansion and contraction mechanism, which can vertically expand and contract, the push-in plate downwardly presses the paper sheet on the escrow plate by the downward expansion of the second expansion and contraction mechanism, then the escrow plate moves to the release position from the hold position, then the paper sheet on the escrow plate is pushed into the paper sheet storing bag by the push-in plate.

12. The paper sheet storing unit according to claim 10, wherein the escrow plate closes a gap above the first retention member and/or the second retention member when moving to the release position from the hold position.

13. A paper sheet storing unit comprising:

a take-in unit that takes a paper sheet into the paper sheet storing unit;

a storing unit in which a paper sheet storing bag to store the paper sheet is detachably placed, the storing unit storing the paper sheet taken into the paper sheet storing unit by the take-in unit;

wherein the storing unit includes a first retention member and a second retention member, the first retention member and the second retention member retaining the paper sheet storing bag while an upper opening of the paper sheet storing bag is opened, the first retention member and the second retention member are separately placed in an identical plane while the paper sheet storing bag is retained between the first retention member and the second retention member, the first retention member and the second retention member can be integrally drawn to an outside from the paper sheet storing unit while retaining the paper sheet storing bag, and the first retention member and the second retention member are disposed so as to be separately arrayed along a direction orthogonal to a drawing direction in which the first retention member and the second retention member are drawn from the paper sheet storing unit, the first retention member is movable toward the second retention member along the direction orthogonal to the drawing direction, and the upper opening of the paper sheet storing bag is sealed when the first retention member moves toward and abuts on the second retention member, wherein an opening is provided in a retained member, and a protrusion member is provided to the first retention member and the second retention member, the protrusion member protruding through the opening of the retained member of the paper sheet storing bag when the paper sheet storing bag is placed in the storing unit, and the paper sheet storing bag is retained by the first retention member and the second retention member when the opening of the retained member is hooked on the protrusion member.

14. The paper sheet storing unit according to claim 13, wherein the protrusion member is provided so as to upwardly extend from each of upper surfaces of the first retention member and the second retention member.

15. The paper sheet storing unit according to claim 13, wherein the protrusion member is retractable into the first retention member and the second retention member, and when the protrusion member retracts into the first retention member and the second retention member, the paper sheet storing bag is released from the first retention member and the second retention member.

16. A paper sheet storing unit comprising:

a take-in unit that takes a paper sheet into the paper sheet storing unit;

a storing unit in which a paper sheet storing bag to store the paper sheet is detachably placed, the storing unit storing the paper sheet taken into the paper sheet storing unit by the take-in unit; and an escrow plate that is provided above the paper sheet storing bag placed in the storing unit and that escrows the paper sheet before the paper sheet transported to the storing unit is stored in the paper sheet storing bag, wherein the storing unit includes a first retention member and a second retention member, the first retention member and the second retention member retaining the paper sheet storing bag while an upper opening of the paper sheet storing bag is opened, the first retention member and the second retention member are separately placed in an identical plane while the paper sheet storing bag is retained between the first retention member and the second retention member, the first retention member and the second retention member can be integrally drawn to an outside from the paper sheet storing unit while retaining the paper sheet storing bag, and the first retention member and the second retention member are disposed so as to be separately arrayed along a direction orthogonal to a drawing direction in which the first retention member and the second retention member are drawn from the paper sheet storing unit, the first retention member is movable toward the second retention member along the direction orthogonal to the drawing direction, and the upper opening of the paper sheet storing bag is sealed when the first retention member moves toward and abuts on the second retention member, wherein the escrow plate is pivoted on a shaft, the escrow plate moves between a horizontally extending hold position and a downwardly or obliquely downwardly extending release position, to which the escrow plate turns about the shaft from the hold position, and the paper sheet transported to the storing unit is escrowed on the escrow plate when the escrow plate is located at the hold position.

* * * * *